US011375862B2

(12) United States Patent
Ko et al.

(10) Patent No.: US 11,375,862 B2
(45) Date of Patent: Jul. 5, 2022

(54) CLEANER STAND AND CLEANING APPARATUS HAVING THE SAME

(71) Applicant: SAMSUNG ELECTRONICS CO., LTD., Suwon-si (KR)

(72) Inventors: Gi Hoon Ko, Suwon-si (KR); Yeon Young Nam, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 316 days.

(21) Appl. No.: 16/425,265

(22) Filed: May 29, 2019

(65) Prior Publication Data

US 2019/0365171 A1 Dec. 5, 2019

(30) Foreign Application Priority Data

May 29, 2018 (KR) ..... 10-2018-0061353

(51) Int. Cl.
*A47L 9/00* (2006.01)
*A47L 9/24* (2006.01)

(52) U.S. Cl.
CPC ..... *A47L 9/0063* (2013.01); *A47L 9/242* (2013.01)

(58) Field of Classification Search
CPC ..... A47L 5/26; A47L 9/0063; A47L 9/242; A47L 9/2873
See application file for complete search history.

(56) References Cited

U.S. PATENT DOCUMENTS 5,926,909 A * 7/1999 McGee ..... A47L 5/24 15/339
10,660,493 B2 * 5/2020 Kim ..... A47L 9/0027
2002/0148070 A1 * 10/2002 Tsuchiya ..... A47L 9/325 15/352
2005/0156562 A1 * 7/2005 Cohen ..... H02J 7/0026 320/107
2011/0219571 A1 * 9/2011 Dyson ..... A47L 9/2873 15/344
2013/0328523 A1 * 12/2013 Ota ..... H02J 7/0045 320/107
2016/0051109 A1 * 2/2016 Hwang ..... A47L 5/225 15/339
2017/0319034 A1 * 11/2017 Kim ..... A47L 9/28
2017/0319035 A1 * 11/2017 Kim ..... A47L 5/28
2017/0319037 A1 * 11/2017 Kim ..... A47L 5/26
2018/0303303 A1 * 10/2018 Nyberg ..... H02J 50/10
2019/0274506 A1 * 9/2019 Kim ..... A47L 9/0027
2019/0320864 A1 * 10/2019 Kim ..... A47L 5/362
(Continued)

FOREIGN PATENT DOCUMENTS

JP 4692858 B1 * 6/2011 ..... A47L 9/0063
JP 2018-15421 2/2018
(Continued)

OTHER PUBLICATIONS

JP-6648648-B2—English Machine Translation (Year: 2020).*
JP-2018015421-A—English Machine Translation (Year: 2018).*
International Search Report dated Sep. 18, 2019 in related International Application No. PCT/KR2019/006388.
(Continued)

*Primary Examiner* — Marc Carlson
(74) *Attorney, Agent, or Firm* — Staas & Halsey LLP

(57) ABSTRACT

A cleaner stand configured to separate only a cleaner body by holding a suction unit or configured to separate the cleaner body coupled to the suction unit by releasing a hold on the suction unit, according to a separation direction of the cleaner body.

19 Claims, 36 Drawing Sheets

(56) References Cited

U.S. PATENT DOCUMENTS

| | | | | |
|---|---|---|---|---|
| 2020/0029760 | A1* | 1/2020 | Seo | A47L 11/2025 |
| 2020/0405113 | A1* | 12/2020 | Hwang | A47L 9/2884 |

FOREIGN PATENT DOCUMENTS

| | | | | | |
|---|---|---|---|---|---|
| JP | 2018015421 | A | * | 2/2018 | |
| JP | 2019030455 | A | * | 2/2019 | |
| JP | 6648648 | B2 | * | 2/2020 | |
| KR | 10-2006-0112420 | | | 11/2006 | |
| KR | 10-2010-0004536 | | | 1/2010 | |
| KR | 10-2010-0007692 | | | 1/2010 | |
| KR | 10-2017-0126380 | | | 11/2017 | |
| KR | 20200028666 | A | * | 3/2020 | |
| WO | 2018/093087 | A1 | | 5/2018 | |
| WO | WO-2020136366 | A1 | * | 7/2020 | A47L 5/26 |

OTHER PUBLICATIONS

Notification of Transmittal of International Search Report and Written Opinion dated Sep. 18, 2019 in related International Application No. PCT/KR2019/006388.

Written Opinion of the International Search Report dated Sep. 18, 2019 in related International Application No. PCT/KR2019/006388.

Extended European Search Report Appl. No. Patent No. 19810123.0-106/Patent No. 3773106 PCT/KR2019006388, dated May 11, 2021.

Chinese Office Action dated Aug. 18, 2021 in Chinese Application No. 201980036533.6.

* cited by examiner

CLEANER STAND AND CLEANING APPARATUS HAVING THE SAME

CROSS-REFERENCE TO RELATED APPLICATION(S)

This application is based on and claims priority under 35 U.S.C. § 119 to Korean Patent Application No. 10-2018-0061353, filed on May 29, 2018, in the Korean Intellectual Property Office, the disclosure of which is incorporated by reference herein in its entirety.

BACKGROUND

1. Field

The disclosure relates to a cleaner stand and a cleaning apparatus having the same, and more particularly to a cleaner stand having an improved separation structure and a cleaning apparatus having the same.

2. Description of Related Art

Generally, a vacuum cleaner is a home appliance that sucks air containing foreign substances such as dust by using vacuum pressure, which is generated by a motor mounted inside a cleaner body, and filters out the foreign substance inside the cleaner body.

Particularly, the vacuum cleaner typically includes a motor for generating a suction pressure, and a suction unit in contact with a surface to be cleaned, by the suction pressure generated by the motor. According to the form of the vacuum cleaner, the vacuum cleaner may be classified into a canister-type cleaner, an upright-type cleaner, a handy-type cleaner and a stick-type cleaner.

The vacuum cleaner may be used with different cleaning tools depending on the type of surface to be cleaned. In this case, a user is required to separate a cleaning tool from the cleaner and couple the cleaning tool to the cleaner. After the use of the vacuum cleaner, a user may need to change the cleaning tool again upon mounting or storing the vacuum cleaner, and it leads to the inconvenience of the user.

SUMMARY

Therefore, it is an aspect of the disclosure to provide a cleaner stand including an improved structure for mounting a cleaner and a cleaning apparatus having the same.

It is another aspect of the disclosure to provide a cleaner stand including an improved separation and coupling structure of a suction unit and a cleaning apparatus having the same.

Additional aspects of the disclosure will be set forth in part in the description which follows and, in part, will be obvious from the description, or may be learned by practice of the disclosure.

In accordance with an aspect of the disclosure, a cleaner stand to which a cleaner including a suction unit and a cleaner body removably locked to the suction unit is mounted, according to a direction in which the cleaner body is separated from the cleaner stand, the cleaner stand is configured to allow only the cleaner body, which is separated from the suction unit, to be separated by holding the suction unit, or allow the cleaner body, which is coupled to the suction unit, to be separated by releasing a hold on the suction unit.

The cleaner body may operate in one state of a coupled state in which the suction unit is locked to the cleaner body, a separated state in which the cleaner body is separated and apart from the suction unit, and a separable state in which the locking is released to be separable from the suction unit, and when the cleaner is mounted to the cleaner stand, the cleaner body may operate in the separable state.

When the cleaner body is separated from the cleaner, which is mounted to the cleaner stand, in a first direction, the cleaner body may be switched from the separable state into the coupled state and when the cleaner body is separated from the cleaner, which is mounted to the cleaner stand, in a second direction different from the first direction, the cleaner body may be switched from the separable state into the separated state.

The first direction may include a forward direction with respect to the cleaner stand, and the second direction may include an upward direction with respect to the cleaner stand.

When the cleaner body is separated in the second direction, the suction unit may be kept in a state of being placed in the cleaner stand.

The cleaner stand may include an unlocking protrusion configured to press a release button of the cleaner to allow the cleaner body to be operated in the separable state, the unlocking protrusion configured to restrict a movement of the suction unit in the second direction.

The unlocking protrusion may include a stopper surface configured to form a lower surface of the unlocking protrusion and configured to be inserted into a groove, which is formed by a pressure applied to the release button, the stopper surface configured to restrict a movement of the suction unit by being in contact with the suction unit when the cleaner body is separated in the second direction.

The stopper surface may be formed with a plane perpendicular to the second direction.

The cleaner stand may further include a stand body configured to form a receiving space in which the cleaner is placed, and the unlocking protrusion may protrude from the stand body to the receiving space.

The cleaner stand may further include a suction unit holder configured to be operated in conjunction with a mounting or separating operation of the suction unit about the receiving space.

When the cleaner is mounted on the cleaner stand, the suction unit holder may correspond to a portion apart from a portion corresponding to the unlocking protrusion in the cleaner.

The suction unit holder together with the unlocking protrusion may restrict a movement of the suction unit when the cleaner body is separated in the second direction.

The suction unit holder may include a holding surface formed with a plane perpendicular to the second direction in a lower surface of the suction unit holder to restrict the movement of the suction unit.

The suction unit holder may further include a mounting guide inclined in the first and second directions to guide the cleaner placed in the stand body.

The cleaner stand may further include a suction unit holder configured to be elastically movable by the movement of the suction unit, and the unlocking protrusion may be positioned in an end portion of the suction unit holder to elastically press the release button.

In accordance with another aspect of the disclosure, a cleaning apparatus includes a cleaner including a cleaner body and a suction unit removably locked to the cleaner body and a cleaner stand to which the cleaner is mounted, and the cleaner body operates in one state of a coupled state in which the suction unit is locked to the cleaner body, a separated state in which the suction unit is separated from the cleaner body, and a separable state in which the suction unit is separable from the cleaner body, and when the cleaner is mounted to the cleaner stand, the cleaner body is switched from the coupled state into the separable state, when the cleaner is separated from the cleaner stand in a first direction, the cleaner body is switched from the separable state into the coupled state, and when the cleaner is separated from the cleaner stand in a second direction different from the first direction, the cleaner body is switched from the separable state into the separated state.

The cleaner may include a release button provided in the suction unit and configured to be pressed to lock or unlock the cleaner body, and the cleaner stand may include a stand body configured to form a receiving space in which a part of the cleaner is placed and an unlocking protrusion formed in the stand body to be exposed to the receiving space and configured to press the release button to allow the cleaner body to operate in the separable state.

The cleaner may further include a button groove formed in a way that the release button is pressed, the button groove into which the unlocking protrusion is inserted, and the unlocking protrusion may include a stopper surface formed to face a button groove forming surface forming a lower surface of the button groove, so as to restrict a movement of the suction unit in the second direction.

The cleaner may further include an insertion groove formed in a position different from the button groove on an outer surface of the suction unit, and the cleaner stand may further include a suction unit holder positioned in the stand body to hold the suction unit, and the suction unit holder may include a holder surface formed to face an insertion groove forming surface forming a lower surface of the insertion groove, so as to restrict a movement of the suction unit in the second direction, together with the stopper surface.

In accordance with another aspect of the disclosure, a cleaning apparatus includes a cleaner including a cleaner body, a suction unit removably locked to the cleaner body and a release button configured to perform a separation operation between the cleaner body and the suction unit, and a cleaner stand to which the cleaner is mounted, and the cleaner stand includes a stand body in which the cleaner is placed, a suction unit holder positioned in the stand body to hold the suction unit, and an unlocking protrusion configured to allow the cleaner body and the suction unit to be separable by operating the release button when the cleaner is mounted to the cleaner stand, and when the cleaner body is separated from the cleaner stand in a first direction, a pressure of the unlocking protrusion applied to the release button is released and as the holding of the suction unit holder applied to the suction unit is released, the suction unit is coupled to the cleaner body so as to be separated together with the cleaner body, and when the cleaner body is separated from the cleaner stand in a second direction different from the first direction, a pressure of the unlocking protrusion applied to the release button is maintained and as the holding of the suction unit holder applied to the suction unit is maintained, the suction unit is separated from the cleaner body and only the cleaner body is separated.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
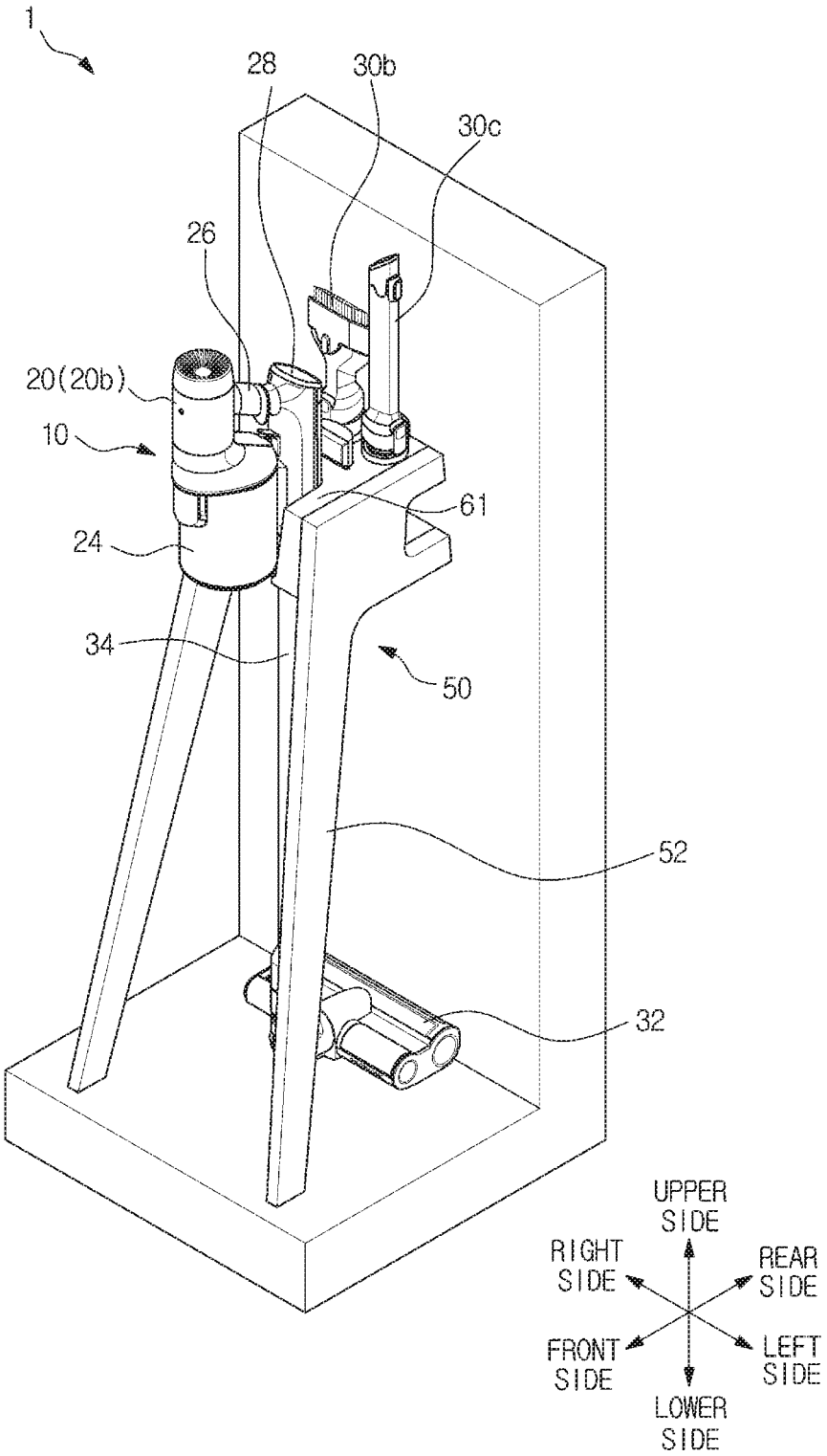
FIGS. 1 and 2 are perspective views of a cleaning apparatus according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter the disclosure will be described more fully hereinafter with reference to the accompanying drawings.

Figure 2:
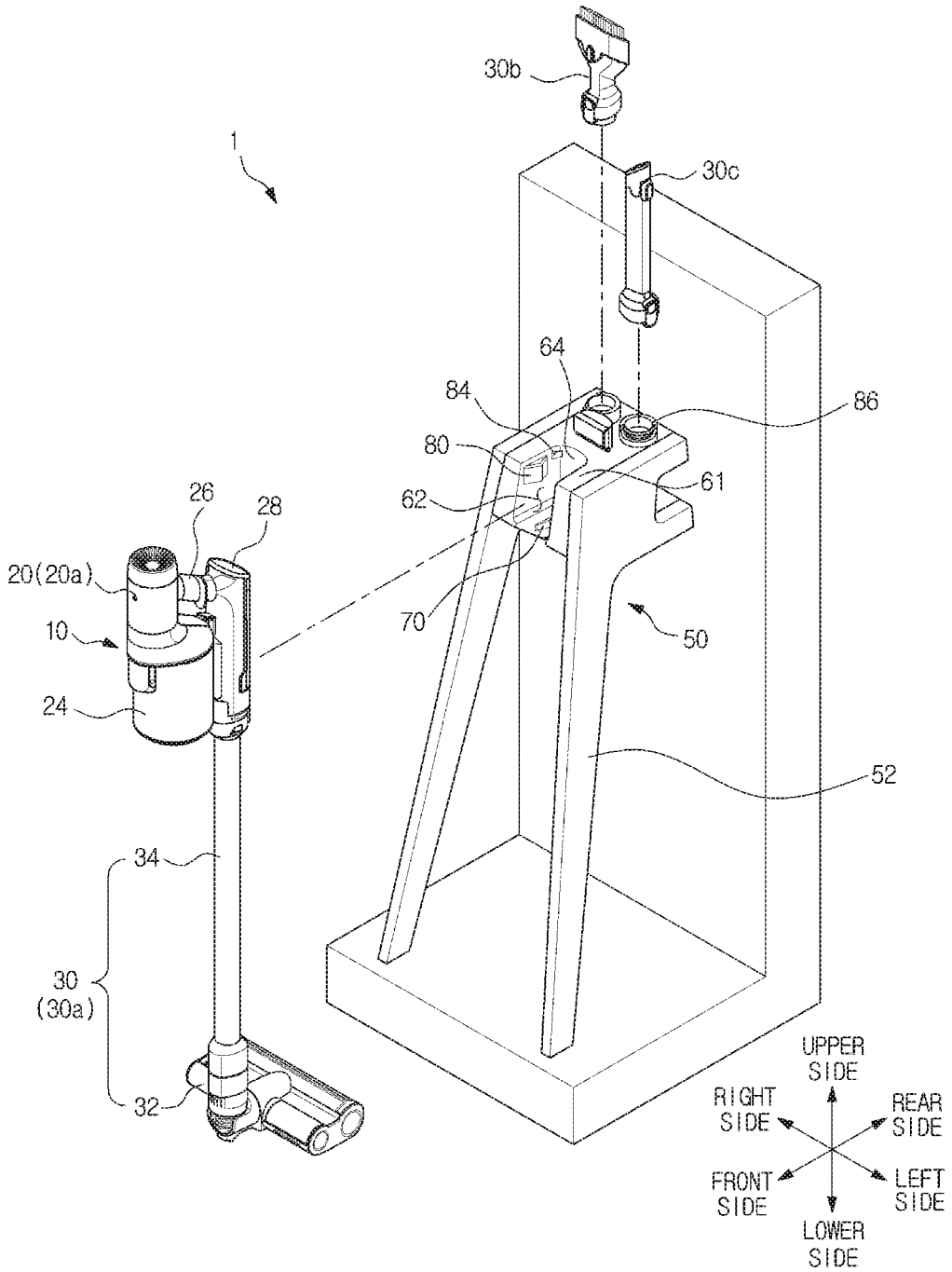
Figure 3:
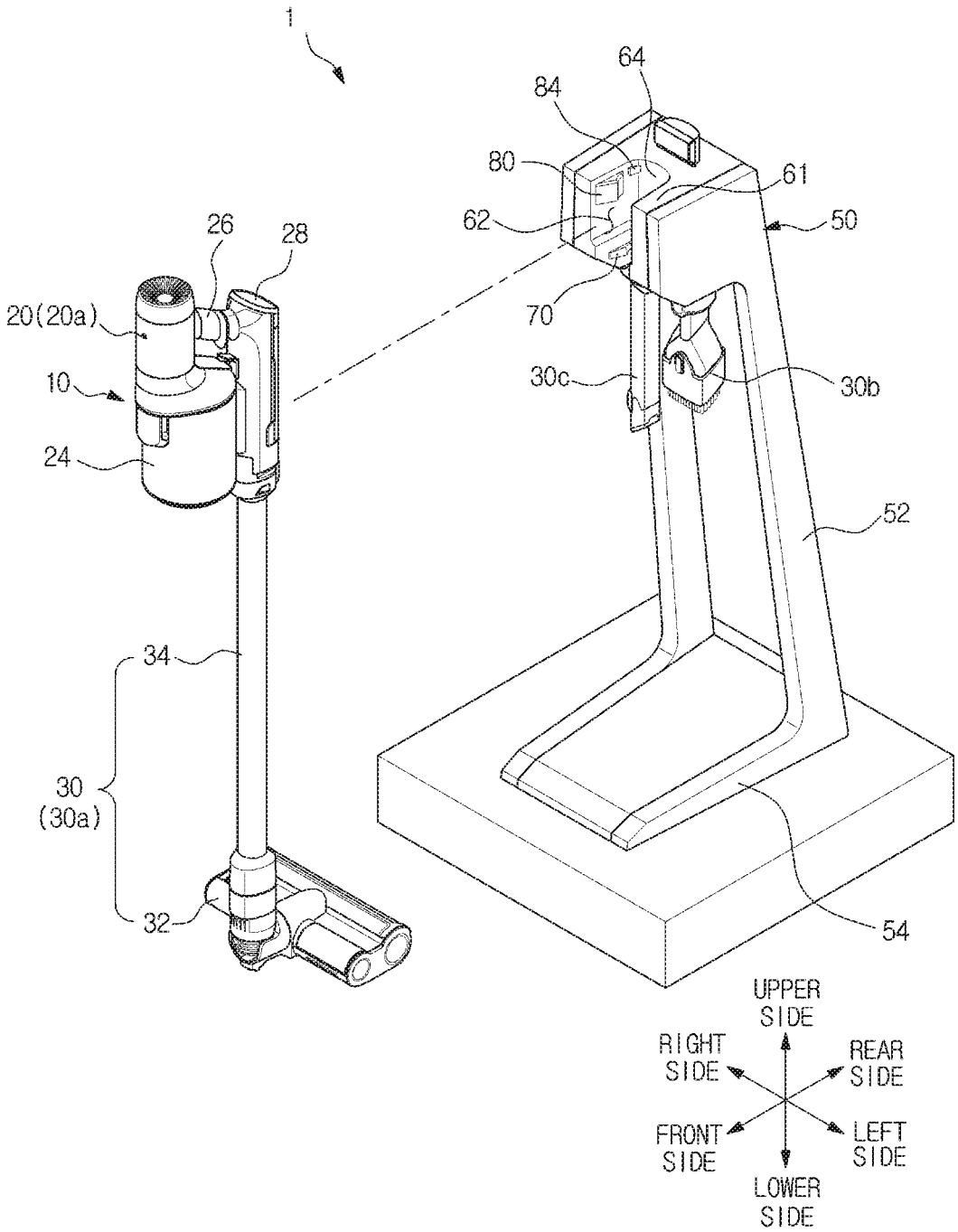
FIG. 3 is a perspective view of the cleaning apparatus to which a cleaner stand having a different shape is applied, in the cleaning apparatus according to an embodiment of the disclosure.

FIGS. 1 and 2 are perspective views of a cleaning apparatus according to an embodiment of the disclosure and FIG. 3 is a perspective view of the cleaning apparatus to which a cleaner stand having a different shape is applied, in the cleaning apparatus according to an embodiment of the disclosure.

A cleaning apparatus 1 may include a cleaner 10 and a cleaner stand 50.

The cleaner stand 50 may be configured to store the cleaner 10 or allow the cleaner 10 to be mounted thereto. The cleaner 10 may be charged in the cleaner stand 50. The cleaner stand 50 may include legs 52 to be supported apart from the floor surface. According to the embodiment, the cleaner stand 50 may lean on the wall surface. The cleaner stand 50 is configured to be supported apart from the floor surface through a pair of legs 52. As well as the cleaner stand 50 is configured to lean on the wall surface, the cleaner stand 50 may be configured to be fixed to the wall surface. However, the shape of the cleaner stand 50 is not limited. For example, through a base 54 placed in the floor surface and a leg 52 connecting the base 54, a stand body 61 of the cleaner stand 50 may be supported against the floor surface, as illustrated in FIG. 3. Alternatively, the cleaner stand 50 may be apart from the floor surface through a single leg.

The cleaner 10 may include a cleaner body 20 and a suction unit 30.

The cleaner body 20 may include a suction motor (not shown) configured to generate a suction force for sucking foreign substances on a surface to be cleaned, and a dust collector 24 in which the foreign substances suctioned from the surface to be cleaned is collected. The dust collector 24 is positioned upstream of an air flow than the suction motor to filter out and collect dust and dirt, which is contained in the air flowing from the suction unit 30. The dust collector 24 may be removably mounted to the cleaner body 20.

The cleaner body 20 may include a handle 26 to allow a user to operate the cleaner 10 by gripping the handle 26. The user may move the cleaner 10 in the front-rear direction by holding the handle 26.

The cleaner body 20 may include a controller 28. A user may turn on or turn off the cleaner 10 or adjust the intensity of the suction of the cleaner 10 by operating a power button provided in the controller 28.

The suction unit 30 may be mounted to the cleaner body 20 and in contact with a surface to be cleaned.

The suction unit 30 may include a suction head 32 and an extension pipe 34.

The suction head 32 is configured to suction foreign substances such as dust, on the surface to be cleaned by being in contact with the surface to be cleaned.

The extension pipe 34 may be configured to connect the suction head 32 to the cleaner body 20. One end of the extension pipe 34 may be pivotally connected to the suction head 32 to allow the suction head 32 to perform the joint movement about the extension pipe 34.

According to the embodiment, a suction unit 30*a* provided with the suction head 32 and the extension pipe 34 is described as an example of the suction unit 30, but is not limited thereto. Alternatively, the suction unit 30 may be a suction unit 30*b* to which a brush is coupled or a suction unit 30*c* including an opening that is narrow to clean a narrow gap. Therefore, there is no limitation in the shape of the suction unit 30.

The cleaner stand 50 may include a connection port 86 to store the various types of suction units 30*b*, and 30*c* described above. The connection port 86 may be formed in the cleaner stand 50. The connection port 86 may be formed to protrude from the cleaner stand 50 and thus various types of suction units may be put and stored therein.

Figure 4:
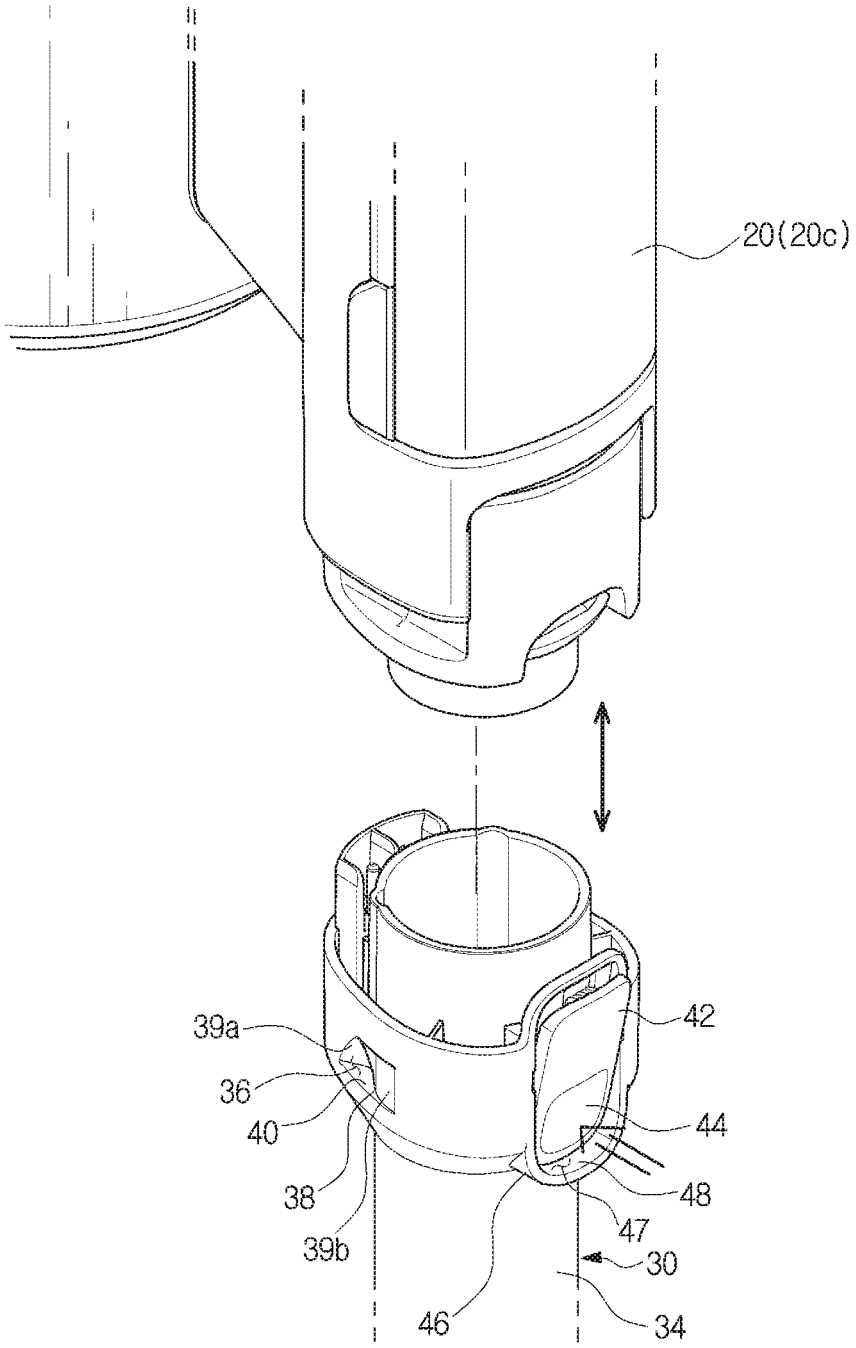
FIG. 4 is a view illustrating a case in which a cleaner body is separated from a suction unit in the cleaning apparatus according to an embodiment of the disclosure.

FIG. 4 is a view illustrating a case in which a cleaner body is separated from a suction unit in the cleaning apparatus according to an embodiment of the disclosure.

The other end of the extension pipe 34 may be removably locked to the cleaner body 20. The cleaner 10 may include a release button 42, and the cleaner body 20 and the suction unit 30 may be separated from each other by operating the release button 42. According to the embodiment, because the release button 42 is positioned at the other end of the extension pipe 34, the cleaner body 20 is separated from or locked to the extension pipe 34 through the operation of the release button 42.

Figure 6:
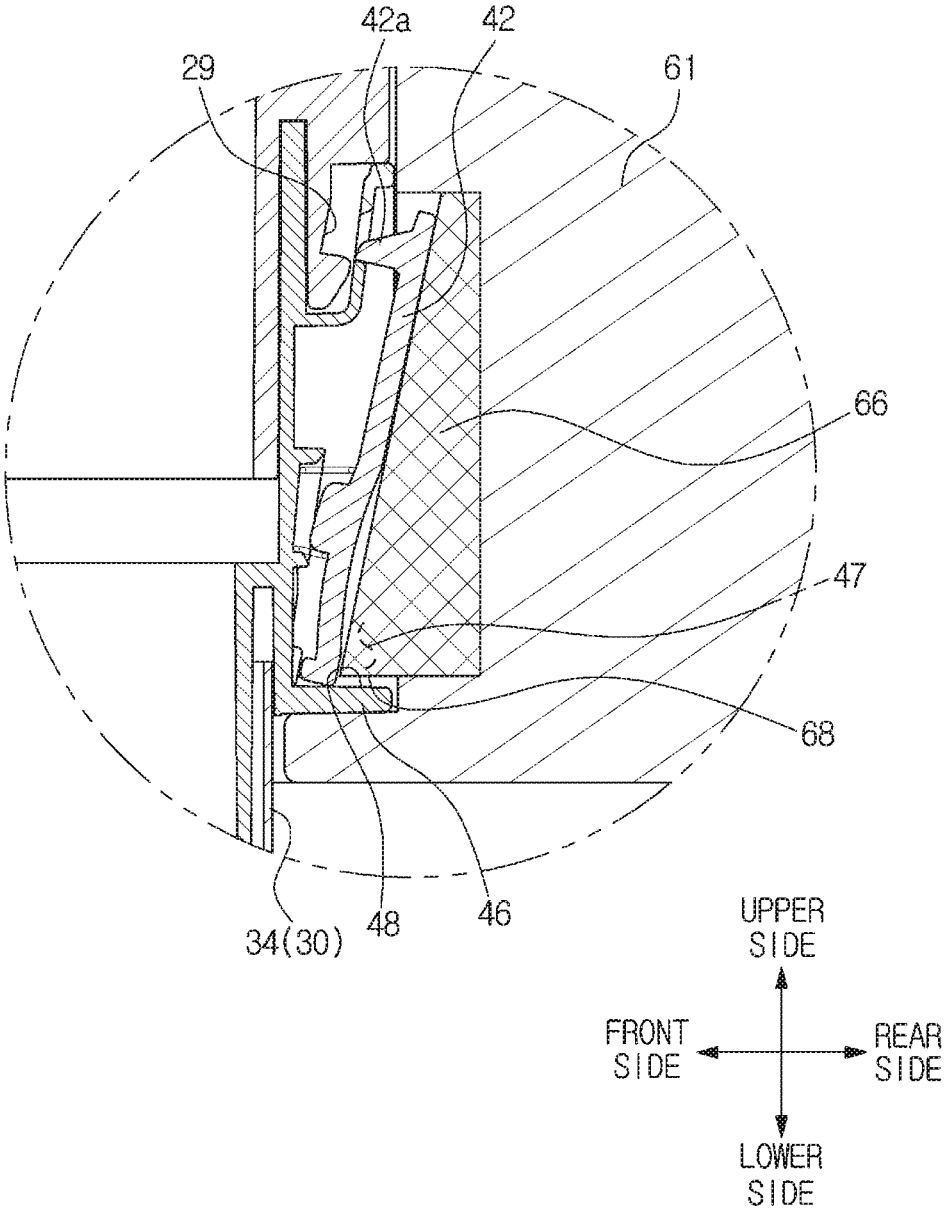
FIG. 6 is a view illustrating a relationship between an unlocking protrusion and a release button of the cleaning apparatus according to an embodiment of the disclosure.

As shown in FIG. 6, the release button 42 may be pressed by a unlocking protrusion 66 to form a holding groove 47 (refer to FIGS. 4 and 6). That is, the unlocking protrusion 66 may be inserted into the holding groove 47 while simultaneously pressing the release button 42.

The cleaner 10 may include a button border 46 surrounding at least a portion of the circumference of the release button 42. The button border 46 forms the holding groove 47 based on a pressure applied to the release button 42 by the unlocking protrusion 66.

The release button 42 having the elasticity is rotatably connected to the suction unit 30. A hook 42*a* formed at one end of the release button 42 is engaged with a locking groove 29 formed at one side of the cleaner body 20, as shown in FIG. 6. When a pressing surface 44 of the other end of the release button 42 is pressed, the release button 42 rotates and one end of the release button 42 is separated from the cleaner body 20, thereby unlocking the cleaner body 20. That is, the hook 42*a* is separated from the locking groove 29, and the locking between the cleaner body 20 and the suction unit 30 is released. According to the embodiment, it has been described that the release button 42 is located on the suction unit 30, but is not limited thereto. Alternatively, the release button 42 may be located in the cleaner body 20 and locked and fixed to one side of the suction unit 30. In addition, the release button 42 is not limited to a configuration that is to be locked or unlocked by pressurization or depressurization. For example, the release button 42 and the unlocking protrusion 66 may be implemented with a contact type sensor or a non-contact type sensor and thus the release button 42 may release the locking by detecting a state in which the cleaner 10 is placed in the cleaner stand 50.

According to the operation of the release button 42, the cleaner body 20 is configured to be operated in three states; a coupled state 20*a* (refer to FIGS. 2, 8, 9, and 13) in which the cleaner body 20 is locked to the suction unit 30, a separated state 20*c* (refer to FIGS. 4 and 14) in which the cleaner body 20 is separated and apart from the suction unit 30, and a separable state 20*b* (refer to FIGS. 1 and 10) in which the locking of the suction unit 30 is released and thus the cleaner body 20 is separable. The separable state 20*b* of the cleaner body 20 represents a state in which the release button 42 is operated. That is, it represents that the cleaner body 20 is not separated from the suction unit 30 but only the release button 42 is pressed.

The suction unit 30 may include a holding groove 36. The holding groove 36 may be formed at the other end of the extension pipe 34. The holding groove 36 is configured to correspond to a suction unit holder 70 described later. The holding groove 36 may be formed in a concave shape to allow the suction unit holder 70 to be inserted thereinto and the holding groove 36 may be formed by a groove forming surface 38.

The holding groove 47 formed by the operation of the release button 42 may be referred to as a first holding groove 47, and the holding groove 36 of the suction unit 30 may be referred to as a second holding groove 36.

Figure 5:
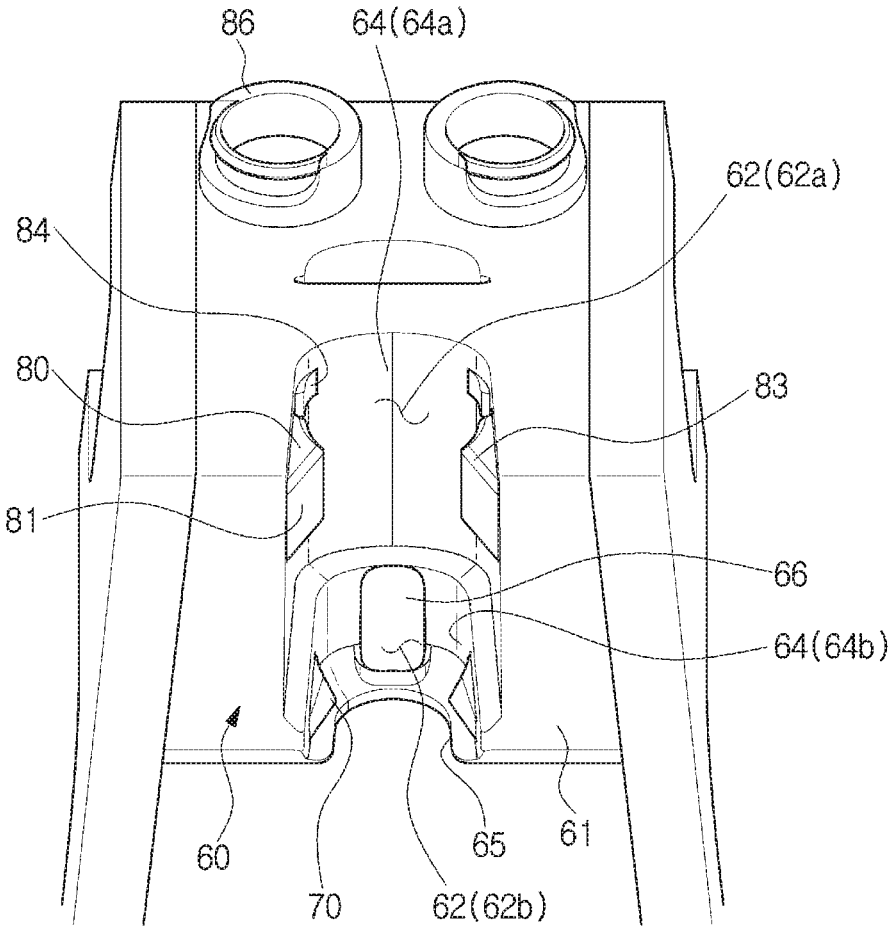
FIG. 5 is a view of a cleaner stand of the cleaning apparatus according to an embodiment of the disclosure.
Figure 7A:
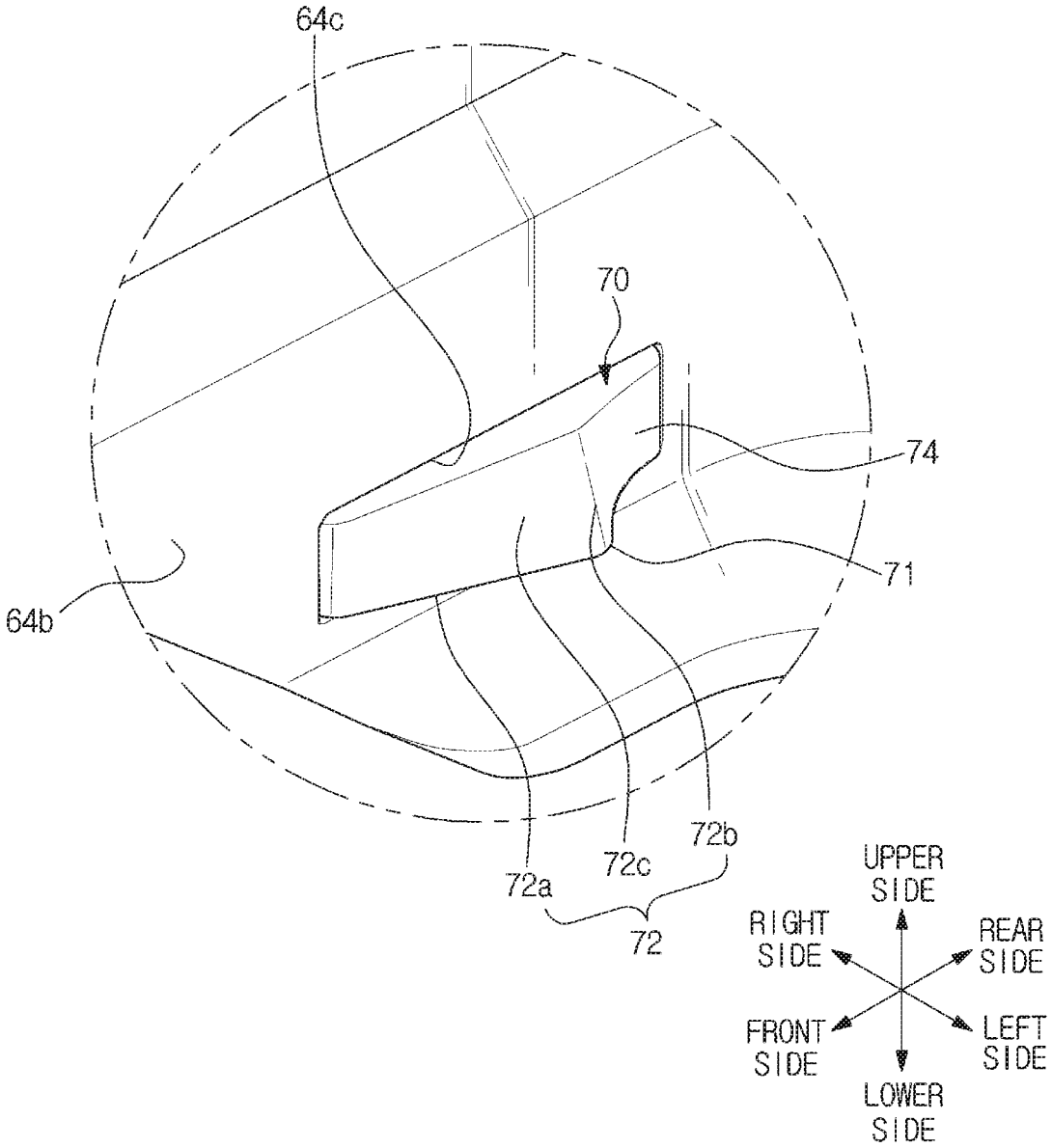
FIG. 7A is an enlarged perspective view of a suction unit holder in the cleaning apparatus according to an embodiment of the disclosure.
Figure 7B:
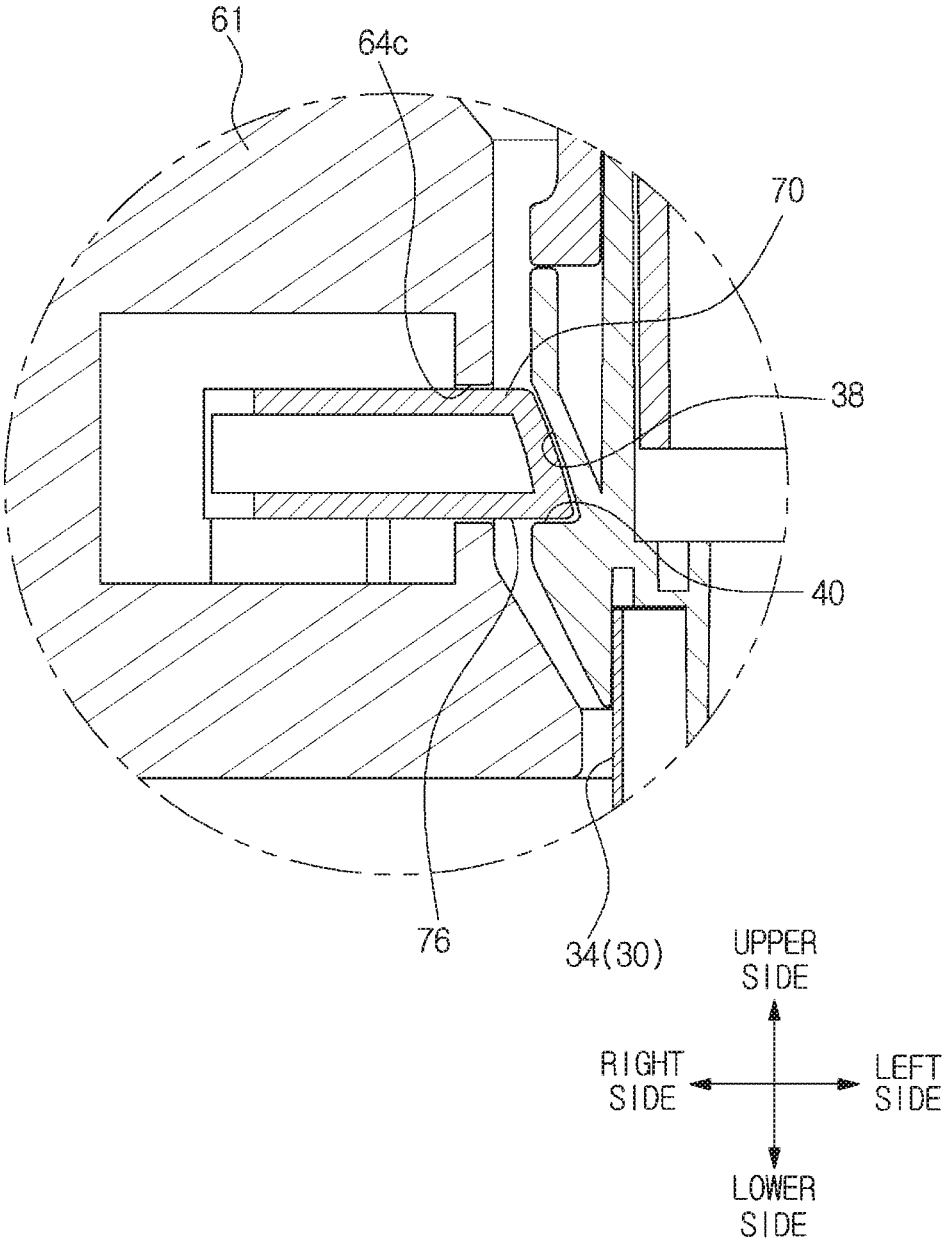
FIG. 7B is a cross-sectional view of the suction unit holder inserted into a cleaner in the cleaning apparatus according to an embodiment of the disclosure.

FIG. 5 is a view of a cleaner stand of the cleaning apparatus according to an embodiment of the disclosure, FIG. 6 is a view illustrating a relationship between an unlocking protrusion and a separation button of the cleaning apparatus according to an embodiment of the disclosure, FIG. 7A is an enlarged perspective view of a suction unit holder in the cleaning apparatus according to an embodiment of the disclosure and FIG. 7B is a cross-sectional view of the suction unit holder inserted into a cleaner in the cleaning apparatus according to an embodiment of the disclosure.

The cleaner stand 50 may be configured to store or charge the cleaner 10. The cleaner 10 may be mounted to the cleaner stand 50.

The cleaner stand 50 may include the stand body 61 receiving a part of the cleaner 10, and the suction unit holder 70 on which the suction unit is mounted.

The stand body 61 may include a seating surface 64 forming a receiving space 62 in which at least one part of the cleaner 10 is placed. The cleaner 10 may be mounted or separated in the forward direction, the upward direction or the diagonal direction between the forward direction and the upward direction with respect to the cleaner stand 50. That is, the receiving space 62 may be configured to be opened in the forward direction, the upward direction or the diagonal direction between the forward direction and the upward direction with respect to the cleaner stand 50.

The stand body 61 includes a body seating surface 64*a* for forming a body receiving space 62*a* in which the cleaner body 20 is placed, and a pipe seating surface 64*b* forming a pipe receiving space 62*b* in which the suction unit 30 is placed. That is, the receiving space 62 may include the body receiving space 62*a* and the pipe receiving space 62*b*. The seating surface 64 may include the body seating surface 64*a* and the pipe seating surface 64*b*.

The stand body 61 may include an opening groove 65. The opening groove 65 is configured to allow the body of the suction unit 30, which is seated on the pipe receiving space 62*b*, to pass through when the cleaner 10 is mounted thereon. Because one end of the suction unit 30 is mounted on the receiving space 62*b*, the remaining part of the suction unit 30 is placed in the outside of cleaner stand 50. The opening groove 65 is configured to allow the body of the suction unit 30 to pass therethrough to prevent the suction unit 30 from interfering with the cleaner stand 50.

The cleaner stand 50 may include the unlocking protrusion 66. The unlocking protrusion 66 releases the locking of the suction unit 30 to the cleaner body 20 by pressing the pressing surface 44 of the release button 42.

The unlocking protrusion 66 is in contact the release button 42 provided on the cleaner 10 when the cleaner 10 is seated in the receiving space 62. According to the embodiment, a contact protrusion presses the release button 42 and thus the locking between the cleaner body 20 and the suction unit 30 is released by the release button 42. That is, because the release button 42 is in contact with the unlocking protrusion 66 or the release button 42 is pressed by the unlocking protrusion 66, the cleaner body 20 may be switched from the coupled state 20*a* into the separable state 20*b*.

The unlocking protrusion 66 may be formed on the seating surface 64 forming the receiving space 62. As the unlocking protrusion 66 is positioned at a position corresponding to the release button 42 of the cleaner 10, the unlocking protrusion 66 is configured to release the locking of the release button 42, which locks the cleaner body 20 in the suction unit 30, when the cleaner 10 is placed in the receiving space 62. The unlocking protrusion 66 may be placed between the suction unit holders 70 described later. In addition, the release button 42 may be positioned in a direction directed to the unlocking protrusion 66. Therefore, when the cleaner 10 is placed in the cleaner stand 50, the release button 42 may be not exposed to the outside.

The unlocking protrusion 66 may include a stopper surface 68. The unlocking protrusion 66 is configured to restrict the upward movement of the suction unit 30 through the stopper surface 68 while pressing the release button 42. The stopper surface 68 may form the lower surface of the unlocking protrusion 66. The stopper surface 68 may be formed with a plane perpendicular to the vertical direction. The stopper surface 68 of the unlocking protrusion 66 is directed to the downward direction, and a movement restricting surface 48 forming the lower portion of the holding groove 47 formed in the release button 42 is formed to be directed to the upward direction. When the unlocking protrusion 66 is inserted into the holding groove 47, the stopper surface 68 and the movement restricting surface 48 face each other. With this configuration, when the suction unit 30 is moved upward, the stopper surface 68 and the movement restricting surface 48 are in surface contact with each other so as to prevent the upward movement of the suction unit 30. That is, the cleaner body 20 is separated from the suction unit 30 and operates in the separated state 20*c*.

The cleaner stand 50 may include the suction unit holder 70. The suction unit holder 70 is provided in the stand body 61 and configured to hold the suction unit 30. The suction unit holder 70 may be a part of the stand body 61. Particularly, the holding groove 36 may be formed at one side of the suction unit 30, and the suction unit holder 70 may be inserted into the holding groove 36. The holding groove 36 may correspond to the suction unit holder 70. According to the embodiment, one side of the extension pipe 34, a pair of holding grooves 36 are provided such that a single holding groove is provided on one of both sides of the extension pipe 34 and the other holding groove is provided on the other side of the extension pipe 34. One pair of the suction unit holders 70 are provided by corresponding to the one pair of the holding grooves 36. However, the arrangement and the number of the holding groove 36 and the suction unit holder 70 are not limited thereto. The holding groove 36 may be formed in a shape corresponding to the shape of the suction unit holder 70. That is, the groove forming surface 38 forming the holding groove 36 may be configured to correspond to the outer surface of the suction unit holder 70.

The suction unit holder 70 may be provided on the pipe seating surface 64*b*. The suction unit holder 70 may protrude from the pipe seating surface 64*b*. At least a part of the suction unit holder 70 may be inserted into an insertion hole 64*c* formed in the pipe seating surface 64*b*. The suction unit holder 70 may be operated with the elasticity. Particularly, the cleaner stand 50 may further include an elastic member 78 (refer to FIG. 12). One end of the elastic member 78 is fixed to the cleaner stand 50, and the other end of the elastic member 78 is fixed to the suction unit holder 70. Therefore, the elastic member 78 is configured to allow the suction unit holder 70 to perform the elastic movement and to return to its original position. With this configuration, during the cleaner 10 is seated in the cleaner stand 50, at least one part of the suction unit holder 70 is inserted into the insertion hole 64*c* by being pressed by the outer surface of the cleaner body 20 or the suction unit 30, and after the cleaner 10 is seated in the cleaner stand 50, the suction unit holder 70 protrudes from the pipe seating surface 64*b* and inserted into the holding groove 36 of the suction unit 30.

The suction unit holder 70 may include a mounting guide 72.

When the cleaner 10 is seated in the cleaner stand 50, the mounting guide 72 of the suction unit holder 70 may be pressed by the outer surface of the cleaner 10. At least one part of the suction unit holder 70 may be inserted into the insertion hole 64*c* by being pressed by the outer surface of the cleaner 10. Particularly, the suction unit holder 70 may be pressed by the outer surface of the suction unit 30. For this operation, the mounting guide 72 may be formed to be inclined to the seating surface 64.

The mounting guide 72 is inclined to allow the cleaner 10 to be placed in the cleaner stand 50 in various directions.

The mounting guide 72 may include first to third guide slopes 72*a*, 72*b* and 72*c*. In the suction unit holder 70, the mounting guide 72 may be inclined from a protruding portion 71, which is the most protruded from the pipe seating surface 64*b*. The cleaner 10 may be seated in the forward direction, the upward direction or the diagonal direction between the forward direction and the upward direction with respect to the cleaner stand 50. By corresponding to a direction in which the cleaner 10 is seated in the cleaner stand 50, the first guide slope 72*a* is inclined to be close to the pipe seating surface 64*b* as the first guide slope 72*a* becomes closer to the front end in the suction unit holder 70, and the second guide slope 72*b* is inclined to be close to the pipe seating surface 64*b* as the second guide slope 72*b* becomes closer to the upper end in the suction unit holder 70. The third guide slope 72*c* may be configured to connect the first guide slope 72*a* to the second guide slope 72*b*. Because the second guide slope 72*b* is inclined to be closer to the pipe seating surface 64*b* as the second guide slope 72*b* becomes closer to the upper end, an upper portion of the second guide slope 72*b* may be closer to the pipe seating surface 64*b* than a lower portion of the second guide slope 72*b*.

According to the embodiment, the first and second guide slopes 72*a* and 72*b* are configured to form an edge of the mounting guide 72, and the third guide slope 72*c* is configured to form an inclined surface between the first and second guide slopes 72*a* and 72*b*. The third guide slope 72*c* may be formed of an inclined curved surface. However, the shape of the guide slop is not limited thereto. Therefore, the first and second guide slopes 72*a* and 72*b* may have an inclined surface by chamfering. There is no limitation in the shape of the first to third guide slopes 72*a*, 72*b*, and 72*c* as long as being inclined in different directions. Alternatively, the first to third guide slopes 72*a*, 72*b*, and 72*c* may be formed as inclined straight edges, or inclined planes, but is not limited thereto and thus the first to third guide slopes 72*a*, 72*b*, and 72*c* may be formed as inclined curved edges or inclined curved surfaces.

The first to third guide slopes 72*a*, 72*b* and 72*c* may be inclined to be close to the pipe seating surface 64*b* in different directions from the protruding portion 71, respectively. With this configuration, the suction unit holder 70 may operate although the cleaner 10 is inserted in the receiving space 62 of the cleaner stand 50 in various directions. In addition, after the cleaner 10 is inserted into the receiving space 62, the suction unit holder 70 may be inserted into the holding groove 36.

The suction unit holder 70 may include a separation guide 74.

When the cleaner 10 seated on the cleaner stand 50 is separated from the cleaner stand 50, the separation guide 74 of the suction unit holder 70 is pressed by the cleaner 10 to allow at least a part of the suction unit holder 70 to be inserted into the insertion hole 64*c*. At least a part of the suction unit holder 70 may be inserted into the seating surface 64*c* by being pressed by the groove forming surface 38 of the holding groove 36 or the suction unit 30.

By corresponding to a direction in which the cleaner 10 is separated from the front side of the cleaner stand 50, the separation guide 74 may be inclined to be close to the pipe seating surface 64*b* as the separation guide 74 becomes closer to the rear end from the suction unit holder 70. The separation guide 74 may be inclined from the protruding portion 71 to be close to the pipe seating surface 64*b* as the separation guide 74 becomes closer to the rear end. According to the embodiment, the separation guide 74 is formed with an inclined surface, which is inclined rearward, and an edge of the inclined surface, but is not limited thereto. The separation guide 74 may be formed with an inclined planar surface or an inclined curved surface, or an inclined straight edge or an inclined curved edge. With this configuration, when the cleaner 10 is separated from the receiving space 62 of the cleaner stand 50 to the front side, at least a part of the suction unit holder 70 may be inserted into the seating surface 64*c* because the separation guide 74 is pressed by the groove forming surface 38. In this process, because the release button 42 is apart from the unlocking protrusion 66 and the state of the cleaner body 20 is switched from the separable state 20*b* into the coupled state 20*a*, the cleaner body 20 together with the suction unit 30 is separated from the cleaner stand 50.

The groove forming surface 38 (refer to FIG. 4) may include first and second slope forming surfaces 39*a* and 39*b* (refer to FIG. 4) inclined to correspond to the mounting guide 72 and the separation guide 74. The groove forming surface 38 may include a movement restricting surface 40 (refer to FIG. 4) corresponding to the stopper surface 76 described later. The movement restricting surface 40 is configured to form a lower surface of the holding groove 36. A movement restricting surface 48 of the lower surface of the first holding groove 47 into which the unlocking protrusion 66 is inserted may be referred to as a first movement restricting surface 48 and a movement restricting surface 40 of the lower surface of the second holding groove 36 may be referred to as a second movement restricting surface 40. The first holding groove 47 may be referred to as a button groove, and the first movement restricting surface 48 may be referred to as a button groove forming surface. The second holding groove 36 may be referred to as an insertion groove, and the second movement restricting surface 40 may be referred to as an insertion groove forming surface.

The suction unit holder 70 may include a stopper surface 76 (refer to FIG. 7B).

The stopper surface 76 allows the suction unit holder 70 to restrict the movement of the suction unit 30 when the cleaner 10 seated in the cleaner stand 50 is separated from the cleaner stand 50.

The stopper surface 76 may form the lower surface of the suction unit holder 70. The stopper surface 76 may be formed with a planar surface perpendicular to the vertical direction. The stopper surface 76 of the suction unit holder 70 is directed downward and the movement restricting surface 40, which forming the lower portion of the holding groove 36 is directed upward. The stopper surface 76 is in contact with the movement restricting surface 40 when the suction unit holder 70 is inserted into the holding groove 36, and thus the stopper surface 76 is configured to prevent the upward movement of the suction unit 30.

When the cleaner 10 is seated on the cleaner stand 50, the cleaner body 20 operates in the separable state 20*b*. When the cleaner body 20 is separated from the cleaner stand 50 to the upper side, the movement restricting surface 40 of the suction unit 30 is in contact with the stopper surface 76 so as to restrict the movement of the suction unit 30. That is, the cleaner body 20 is separated from the suction unit 30 and then operates in the separated state 20*c*.

The stopper surface 68 of the unlocking protrusion 66 may be referred to as a first stopper surface 68 (refer to FIG. 8), and the stopper surface 76 of the suction unit holder 70 may be referred to as a second stopper surface 76. The first stopper surface 68 is in contact with the second movement restricting surface 48 to restrict the upward movement of the suction unit 30 on the side of the release button 42 of the suction unit 30. The second stopper surface 76 is in contact with the second movement restricting surface 40 to restrict the upward movement of the suction unit 30 on both sides of the suction unit 30. The first and second stopper surfaces and the first and second movement restricting surfaces are arranged along the periphery of the suction unit 30 to restrict the upward movement of the suction unit 30, and thus the cleaner body 20 may be stably switched from the separable state 20*b* into the separated state 20*c*. The second stopper surface 76 may be referred to as a holder surface.

The cleaner stand 50 may include a body holder 80. The body holder 80 may be configured to elastically protrude from the seating surface 64 or configured to allow at least a part thereof to be elastically inserted into the inside of the seating surface 64. That is, after the body holder 80 is pressed by the cleaner body 20, the body holder 80 may perform the elastic movement and return to its original position when the cleaner body 20 is seated or when the cleaner body 20 is separated.

The body holder 80 is configured to stably support the cleaner body 20 when the cleaner body 20 is seated on the cleaner stand 50. The body holder 80 may include a first body guide surface 81, and the first body guide surface 81 is inclined to allow the body holder 80 to be inserted into the inside of the seating surface 64 by an external force of the cleaner body 20 when the cleaner body 20 is inserted into the receiving space 62. The first body guide surface 81 may be inclined to be close to the seating surface 64 as the first body guide surface 81 becomes closer to the forward end. The body holder 80 may include a second body guide surface 82 (refer to FIG. 8). The second body guide surface 82 is provided on the rear portion of the body holder 80, and configured to be inclined to allow the body holder 80 to be inserted into the inside of the seating surface 64 by an external force of the cleaner body 20 when the cleaner 10 seated in the cleaner stand 50 is separated from the cleaner stand 50. The second body guide surface 82 may be inclined to be close to the seating surface 64 as the second body guide surface 82 becomes closer to the rearward end.

The body holder 80 may include a third body guide surface 83. The third body guide surface 83 is provided in the upper portion of the body holder 80, and configured to be inclined to guide the insertion of the cleaner 10 from the upper side or the diagonal direction to the receiving space 62.

The cleaner stand 50 may include a buffer member 84.

The buffer member 84 may be formed on the seating surface 64. The buffer member 84 may alleviate the collision between the outer surface of the cleaner body 20 and the seating surface 64 of the cleaner stand 50 when the cleaner 10 is mounted on the cleaner stand 50. According to the embodiment, a pair of the buffer member 84 are provided and positioned symmetrically with respect to the body seating surface 64*a*. However, the number and arrangement of the buffer members 84 are not limited thereto.

Hereinafter the operation of mounting or separating the cleaner in the cleaning apparatus according to an embodiment of the disclosure will be described.

First, an operation of mounting the cleaner 10 to the cleaner stand 50 will be described.

Figure 8:
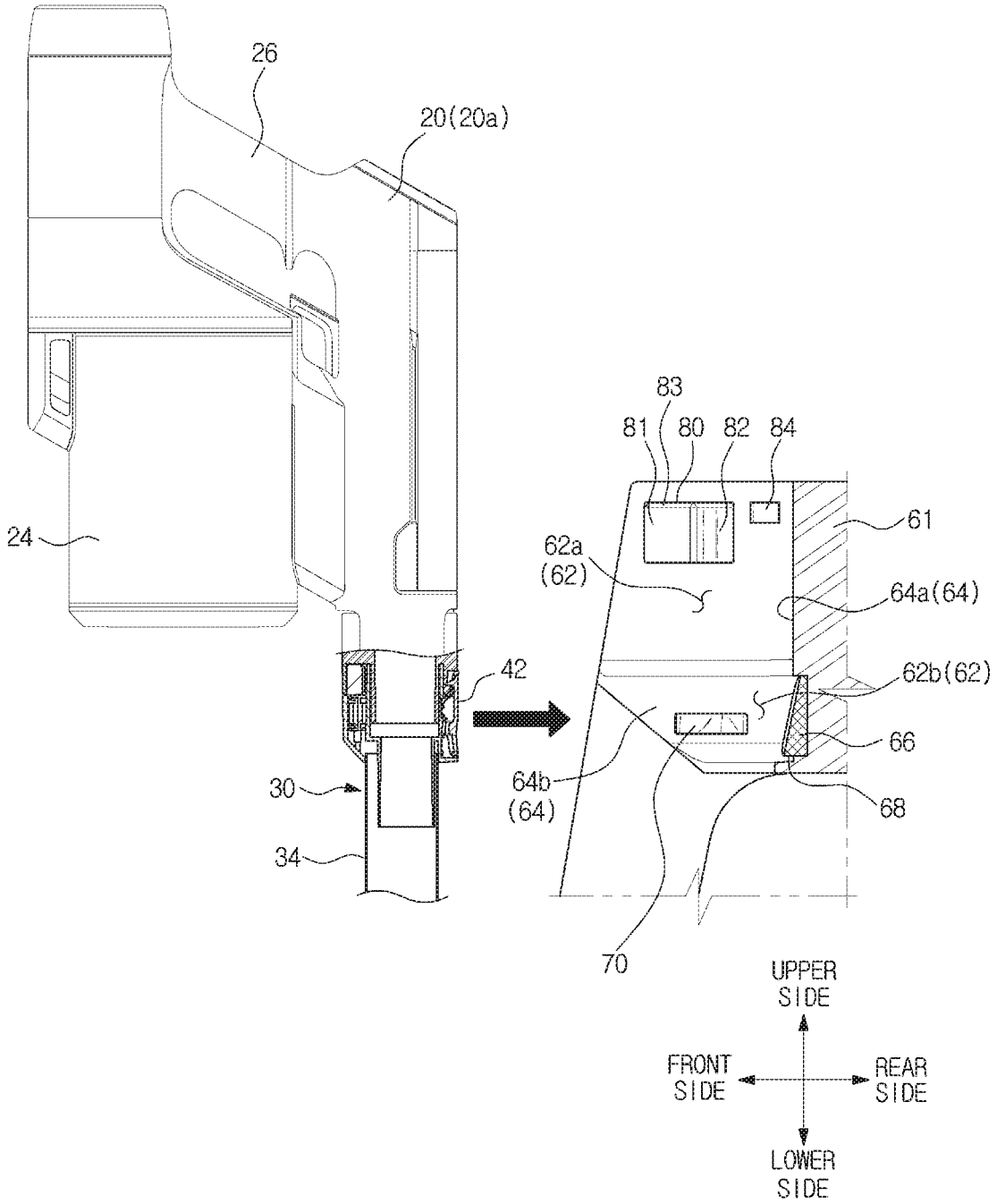
FIGS. 8 and 9 are views illustrating a case in which the cleaner is mounted to the cleaner stand in the cleaning apparatus according to an embodiment of the disclosure.
Figure 9:
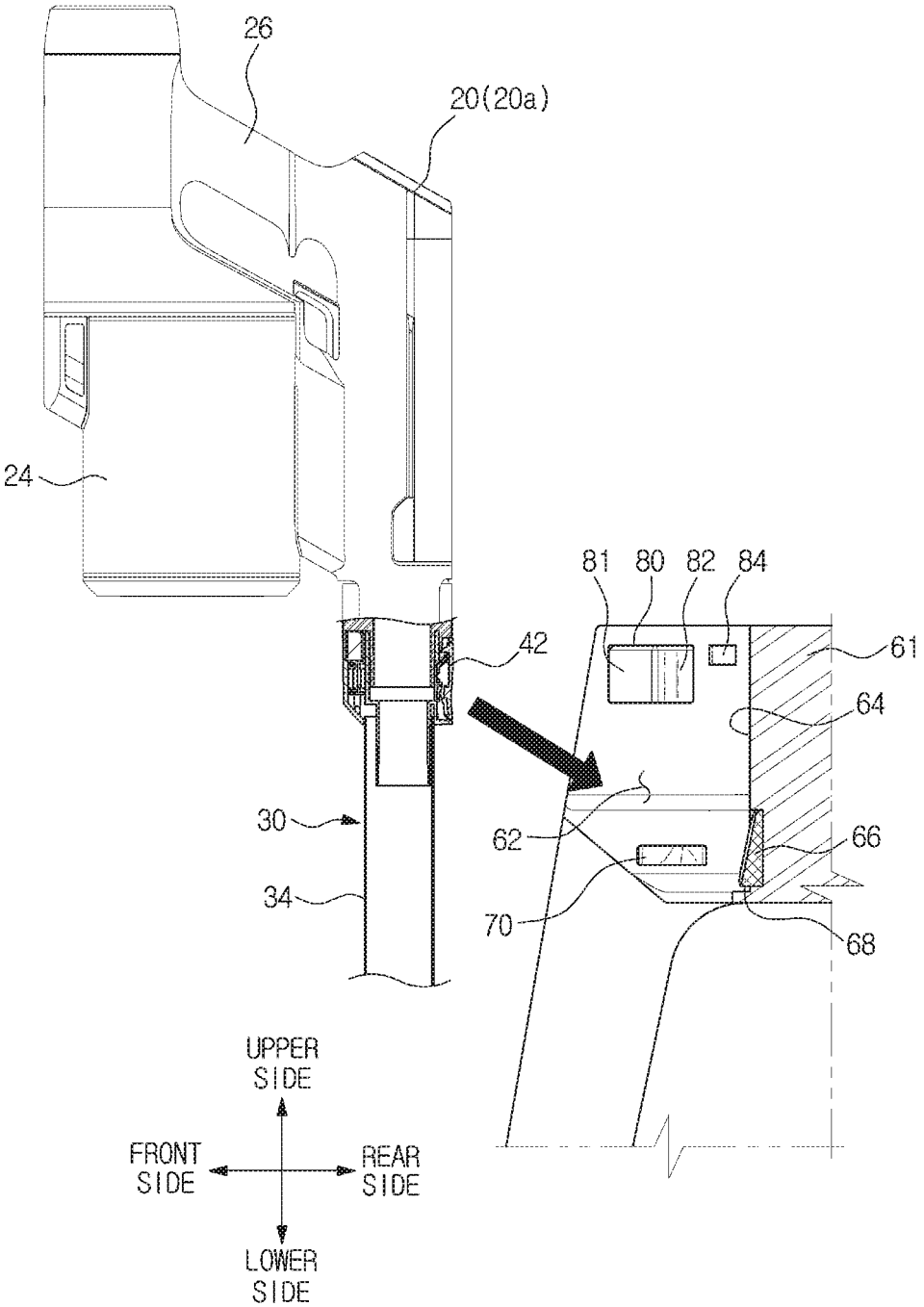

FIGS. 8 and 9 are views illustrating a case in which the cleaner is mounted to the cleaner stand in the cleaning apparatus according to an embodiment of the disclosure.

The cleaner 10 may be placed on the cleaner stand 50 in a state where the cleaner body 20 and the suction unit 30 are locked to each other. That is, in the coupled state 20*a* or the separated state 20*c*, the cleaner body 20 may be placed in the receiving space 62 of the cleaner stand 50.

The cleaner 10 may be placed in the forward direction, the upward direction or the diagonal direction between the forward direction and the upward direction with respect to the cleaner stand 50. FIGS. 8 and 9 illustrate that the cleaner 10 is placed in the forward direction, and the diagonal direction with respect to the cleaner stand 50, but is not limited thereto. The cleaner 10 may be placed in the cleaner stand 50 in the upward direction.

During the cleaner 10 is mounted to the cleaner stand 50, the mounting guide 72 of the suction unit holder 70 is elastically inserted into the seating surface 64 by the pressure of the outer surface of the cleaner 10. The first to third guide slopes 72*a*, 72*b* and 72*c* are inclined in the forward direction, the upward direction or the diagonal direction between the forward direction and the upward direction in the suction unit holder 70. Therefore, through the first to third guide slopes 72*a*, 72*b* and 72*c*, the suction unit holder 70 is operated in conjunction with the mounting operation of the cleaner 10 despite of the different mounting direction of the cleaner 10. When the cleaner 10 is mounted on the cleaner stand 50, the suction unit holder 70 returns to its original position with the elasticity and then inserted into the holding groove 36 of the suction unit 30.

Next, a state in which the cleaner 10 is mounted on the cleaner stand 50 will be described.

Figure 10:
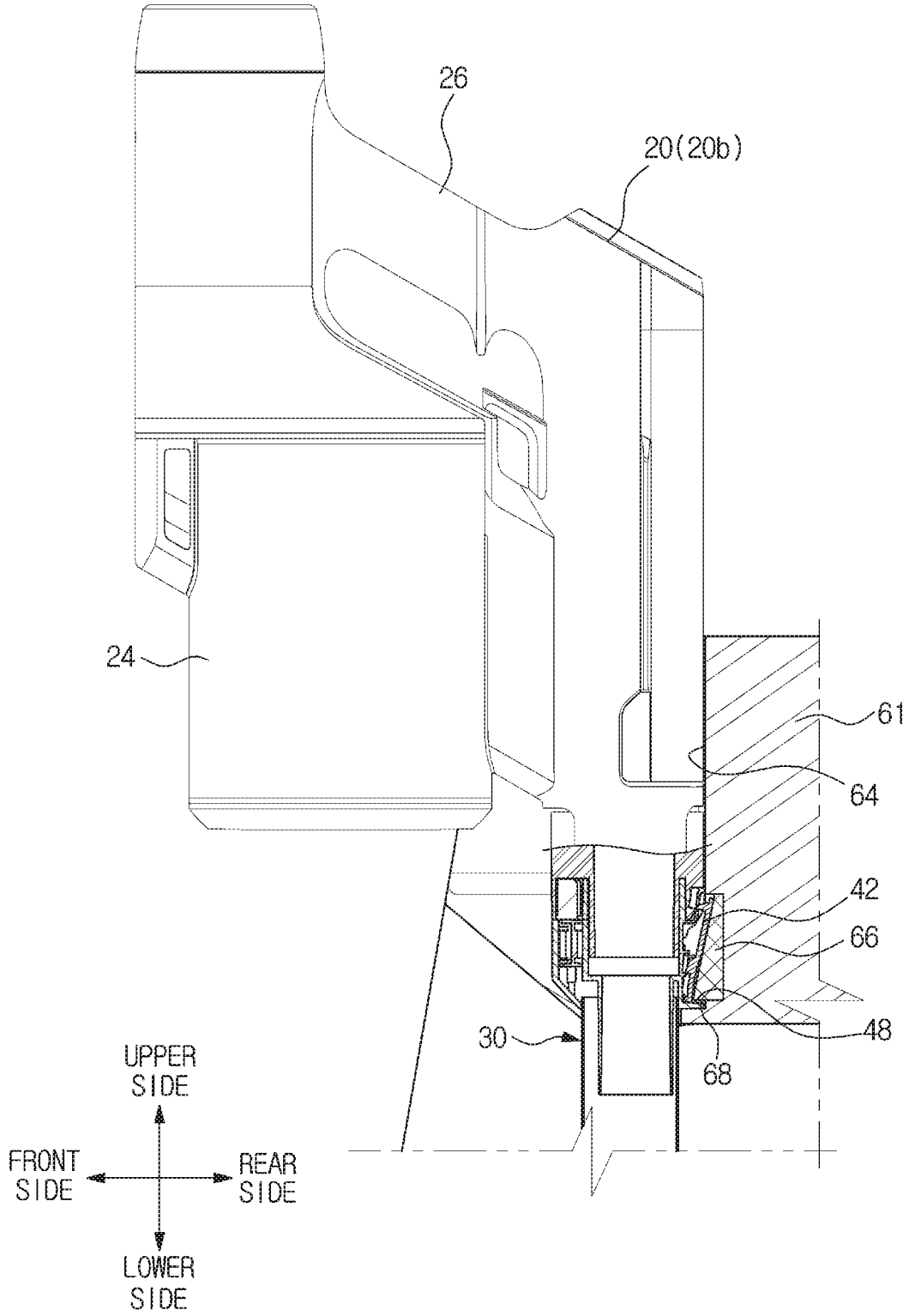
FIGS. 10, 11 and 12 are views illustrating a relationship between the cleaner and the cleaner stand when the cleaner is mounted to the cleaner stand, in the cleaning apparatus according to an embodiment of the disclosure.
Figure 11:
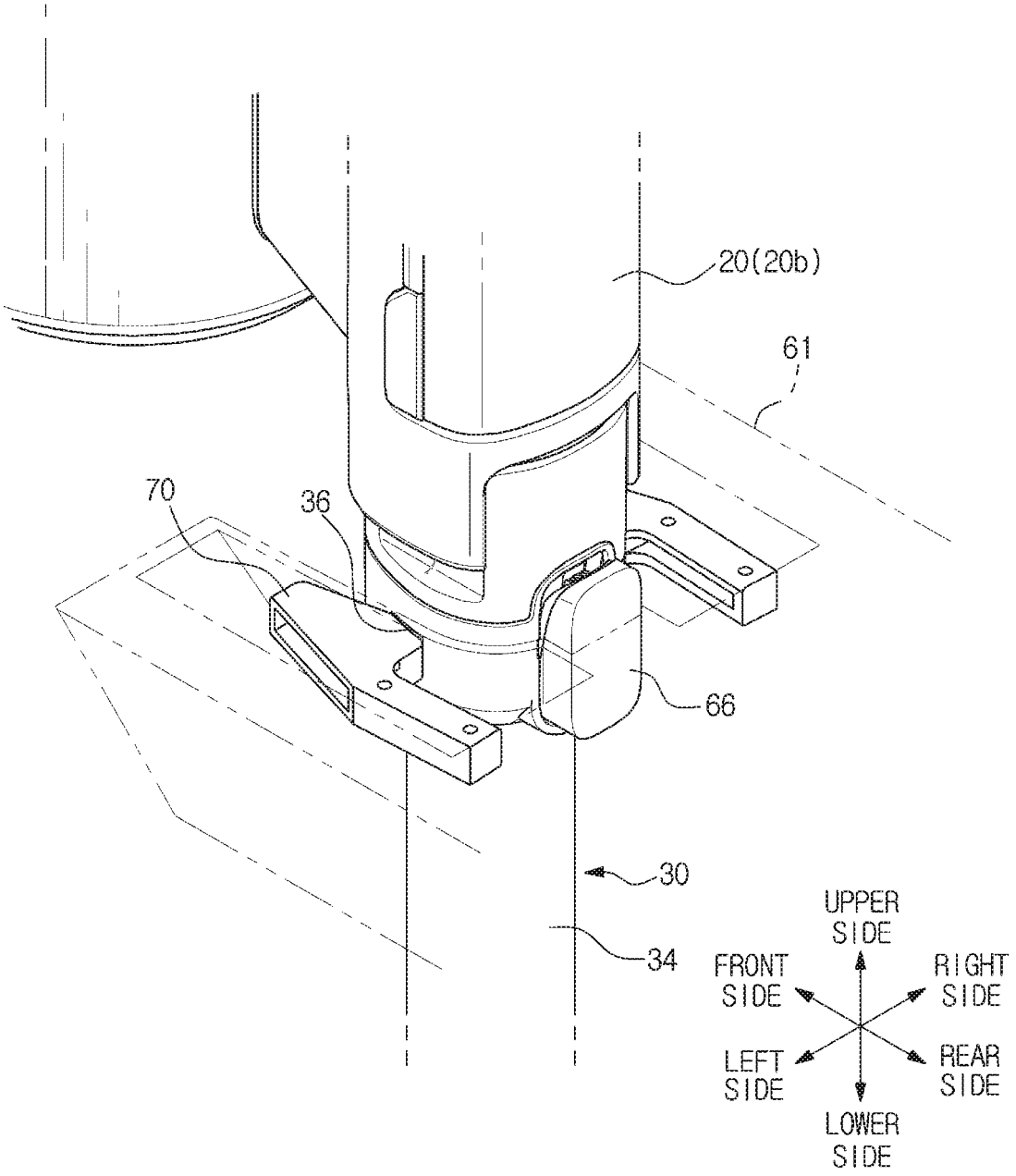
Figure 12:
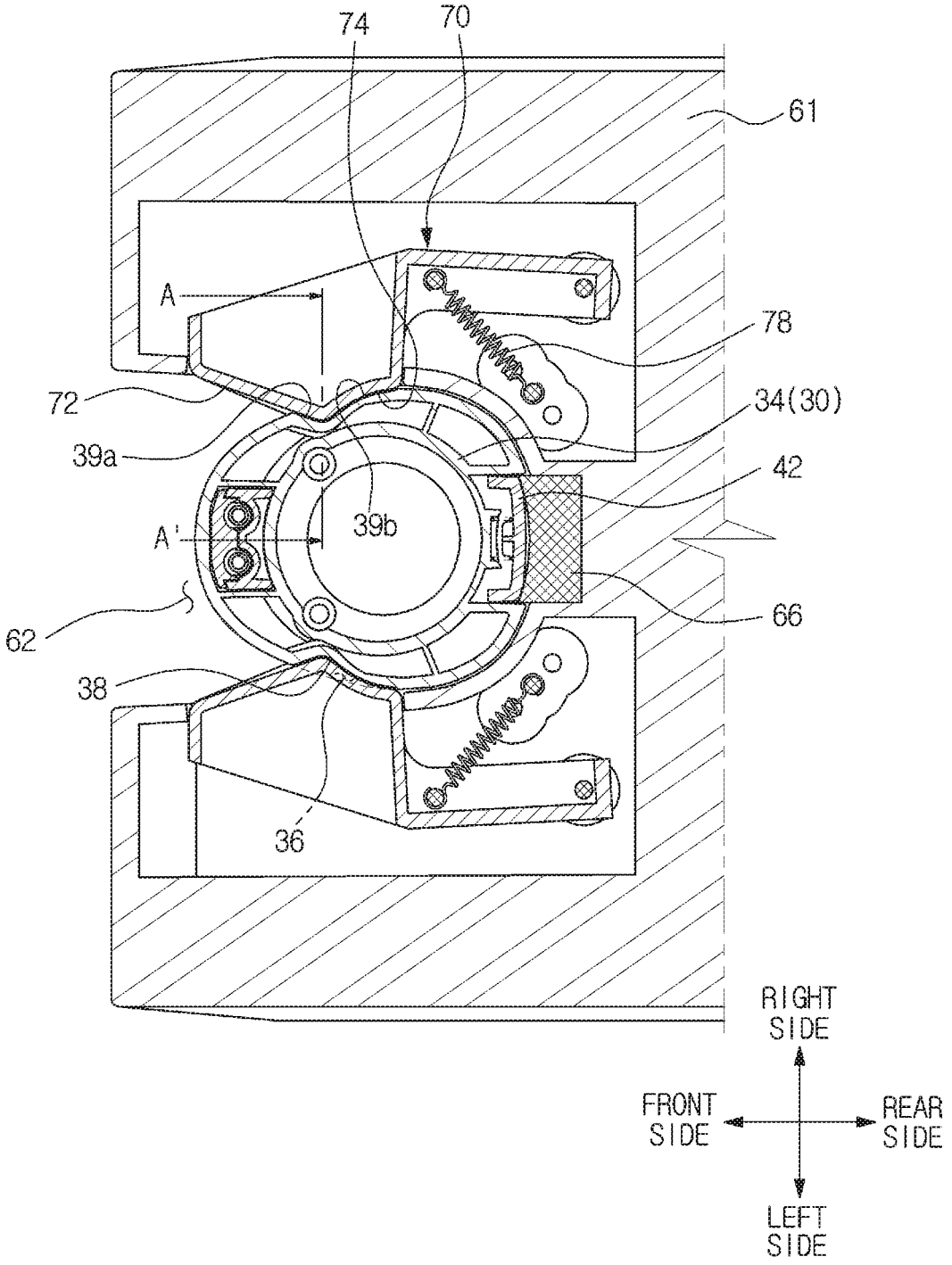

FIGS. 10 to 12 are views illustrating a relationship between the cleaner and the cleaner stand when the cleaner is mounted to the cleaner stand, in the cleaning apparatus according to an embodiment of the disclosure.

When the cleaner 10 is mounted on the cleaner stand 50, the release button 42 is operated to allow the cleaner body 20 and the suction unit 30 to be separable. That is, the unlocking protrusion 66 presses the release button 42 and then inserted into the first holding groove 47 generated by the movement of the release button 42. In this process, the cleaner body 20 is switched from the coupled state 20*a* into the separable state 20*b*. In a state in which only the suction unit 30 is mounted on the cleaner stand 50, when the cleaner body 20 in the separated state 20*c* is mounted on the cleaner stand 50, the cleaner body 20 is switched from the separated state 20*c* into the separable state 20*b*. As the cleaner 10 is mounted on the cleaner stand 50, the release button 42 of the cleaner 10 is operated by being in contact with the unlocking protrusion 66 or by being pressed by the unlocking protrusion 66, as illustrated in FIG. 10. Therefore, the locking between the cleaner body 20 and the suction unit 30 is released. In addition, the suction unit holder 70 is inserted into the second holding groove 36 of the cleaner 10.

Next, an operation of separating the cleaner 10 from the cleaner stand 50 will be described.

Figure 13:
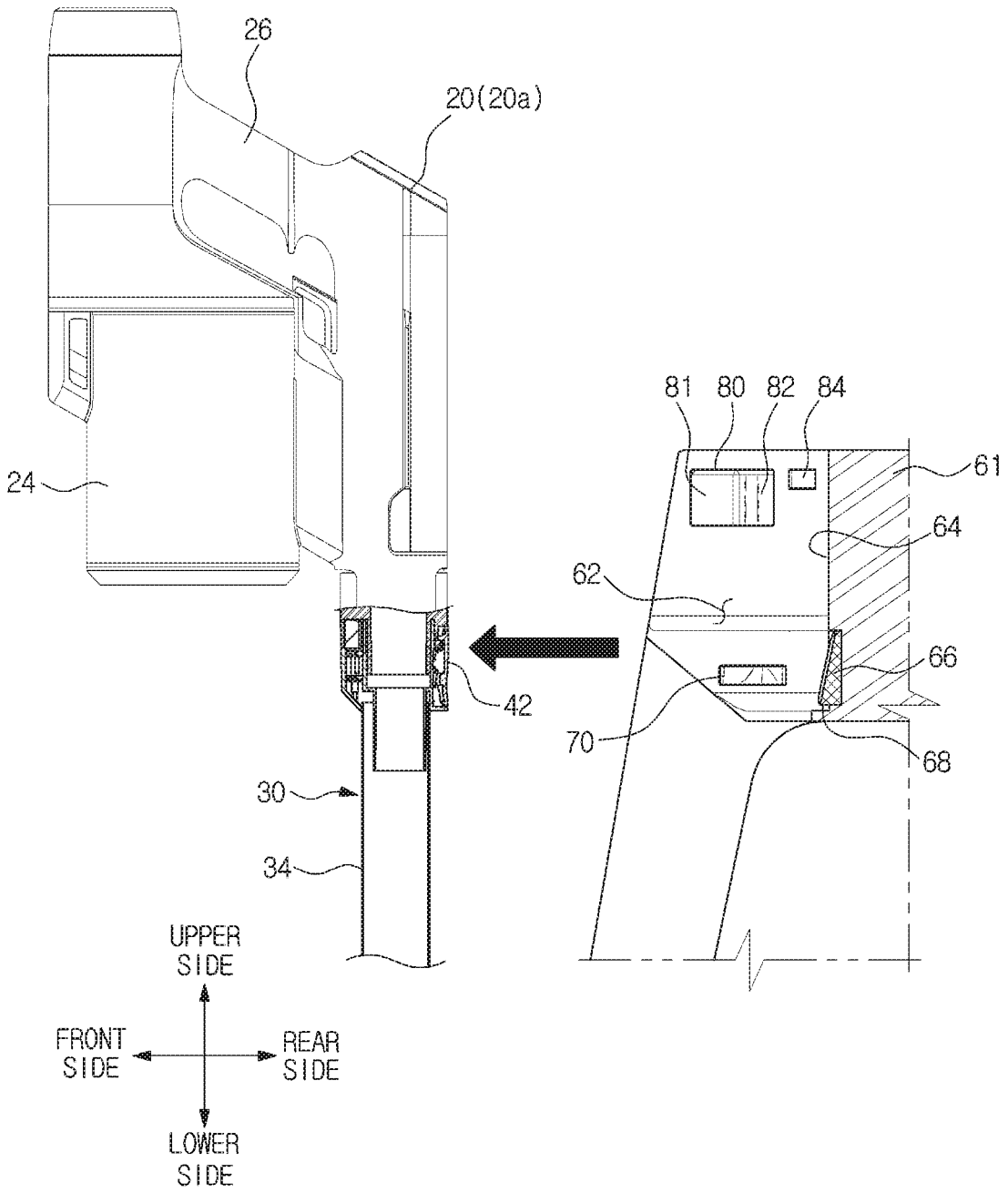
FIGS. 13 and 14 are views illustrating a case in which the cleaner is separated from the cleaner stand, in the cleaning apparatus according to an embodiment of the disclosure.
Figure 14:
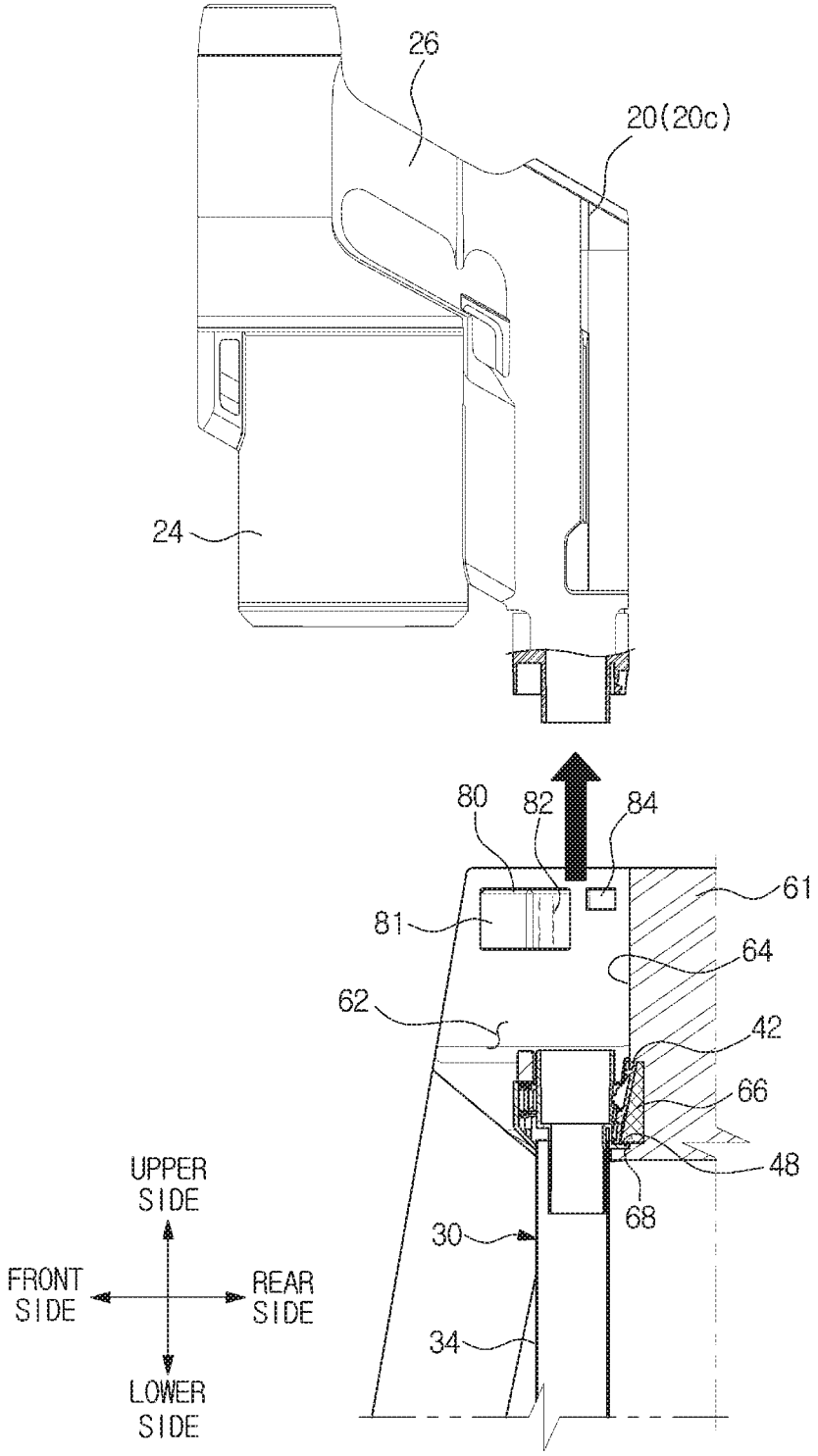

FIGS. 13 and 14 are views illustrating a case in which the cleaner is separated from the cleaner stand, in the cleaning apparatus according to an embodiment of the disclosure.

When the cleaner body 20 is separated frontward from the cleaner stand 50, as illustrated in FIG. 13, the release button 42 is apart from the unlocking protrusion 66. That is, the release button 42 allows the cleaner body 20 and the suction unit 30 to be locked to each other, again. In other words, the cleaner body 20 is switched from the separable state 20*b* into the coupled state 20*a*.

When the cleaner body 20 is separated frontward from the cleaner stand 50, the suction unit holder 70 is pressed as the separation guide 74 slides on the inclined groove forming surface 38 of the holding groove 36. The suction unit holder 70 is inserted into the seating surface 64. The cleaner 10 is separated from the receiving space 62, and at the same time, the suction unit holder 70 returns to its original position with the elasticity.

With this operation, the cleaner body 20 is switched into the coupled state 20*a*, and the user can use the cleaner 10 equipped with the suction unit 30.

An operation of separating the cleaner body 20 upward from the cleaner stand 50 as shown in FIG. 14 will be described.

When the cleaner body 20 is separated upward from the cleaner stand 50, the first movement restricting surface 68 of the unlocking protrusion 66 is locked to the first stopper surface 48 of the first holding groove 47. In addition, as for the suction unit holder 70, the second movement restricting surface 40 is locked to the second stopper surface 76 of the second holding groove 36. That is, the first and second stopper surfaces 48 and 76 face the first and second movement restricting surfaces 68 and 40, and thus the suction unit holder 70 prevents the upward movement of the suction unit 30. According to the embodiment, it has been described that the first and second stopper surfaces 48 and 76 face the first and second movement restricting surfaces 68 and 40, but is not limited thereto. Alternatively, it is sufficient that any one stopper faces a corresponding movement restricting surface.

The release button 42 is configured to keep the pressure with the unlocking protrusion 66 when the cleaner body 20 is separated upward from the cleaner stand 50. That is, because the upward movement of the suction unit 30 is restricted by the suction unit holder 70 and the unlocking protrusion 66, the pressure of the unlocking protrusion 66 applied to the release button 42 of the suction unit 30 is maintained. Accordingly, the cleaner body 20 is separated from the suction unit 30. That is, the cleaner body 20 is switched from the separable state 20*b* into the separated state 20*c*.

As for the direction in which the cleaner body 20 is separated, the forward direction may be defined as a first direction and the upward direction may be defined as a second direction. However, the first and second directions are not limited to the forward direction and the upward direction. Therefore, the first and second directions may vary according to the arrangement of the stopper surface 76, the suction unit holder 70, the unlocking protrusion 66 or the release button 42. According to the embodiment, because the stopper surface 76 is a plane directed downward and the movement restricting surface 40 is a plane directed upward, the suction unit holder 70 restricts the upward movement of the suction unit 30. Alternatively, the stopper surface 76 may be a plane directed diagonally downward and the movement restricting surface 40 may be a plane directed diagonally upward. In this case, the suction unit holder 70 may restrict the diagonal movement of the suction unit 30.

The first and second directions are not limited to the forward direction and the upward direction, and thus the first and second directions may be defined as different directions. According to the embodiment, the first direction has been described as the forward direction from the cleaner stand 50, but is not limited thereto. Therefore, the first direction may include the diagonal direction between the forward direction and the upward direction.

As mentioned above, by changing the direction in which the cleaner 10 is separated from the cleaner stand 50, it is possible to separate only the cleaner body 20 or separate the cleaner body 20 on which the suction unit 30 is mounted. It is possible to couple or separate various cleaning tools to or from the cleaner body 20 by controlling the coupling direction or the separation direction of the cleaner 10.

Hereinafter a cleaning apparatus according to another embodiment of the disclosure will be described.

In the description, the same elements as those described above will not be described again. In this embodiment, a separation button position of a cleaner, a suction unit holder, and an unlocking protrusion are different from those of the above-described embodiment.

Figure 15:
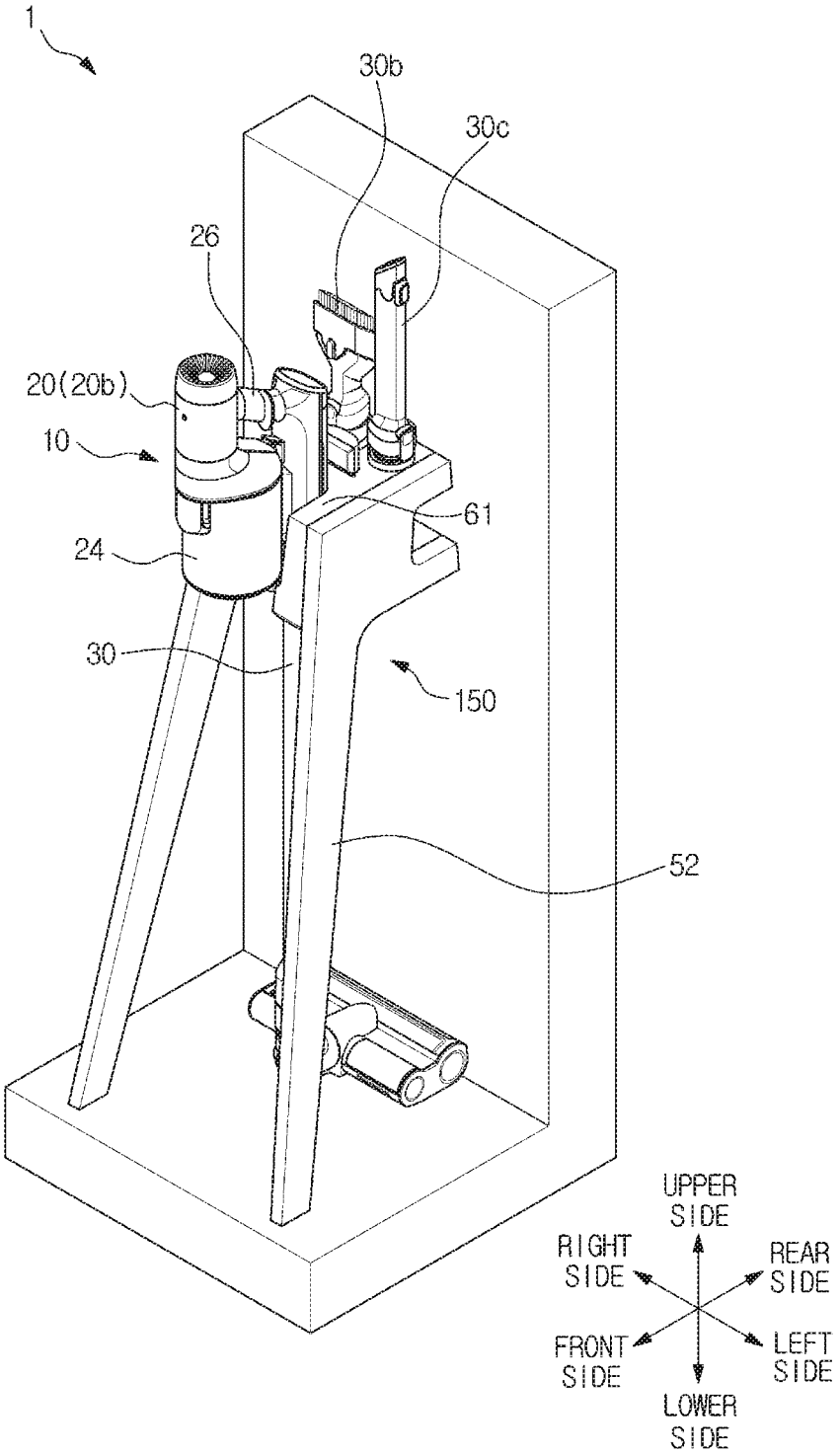
FIGS. 15 and 16 are perspective views of a cleaning apparatus according to another embodiment of the disclosure.
Figure 16:
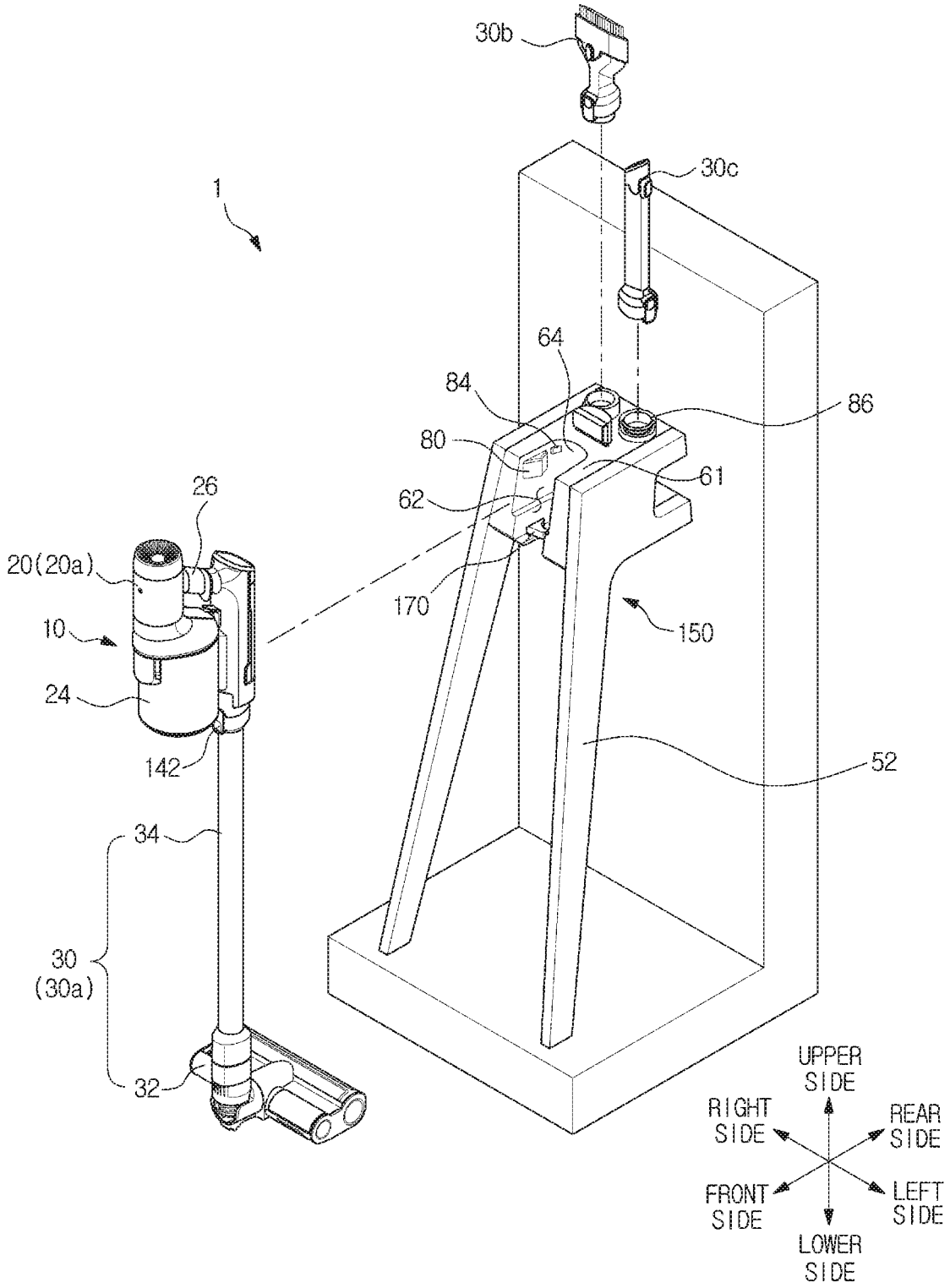
Figure 17:
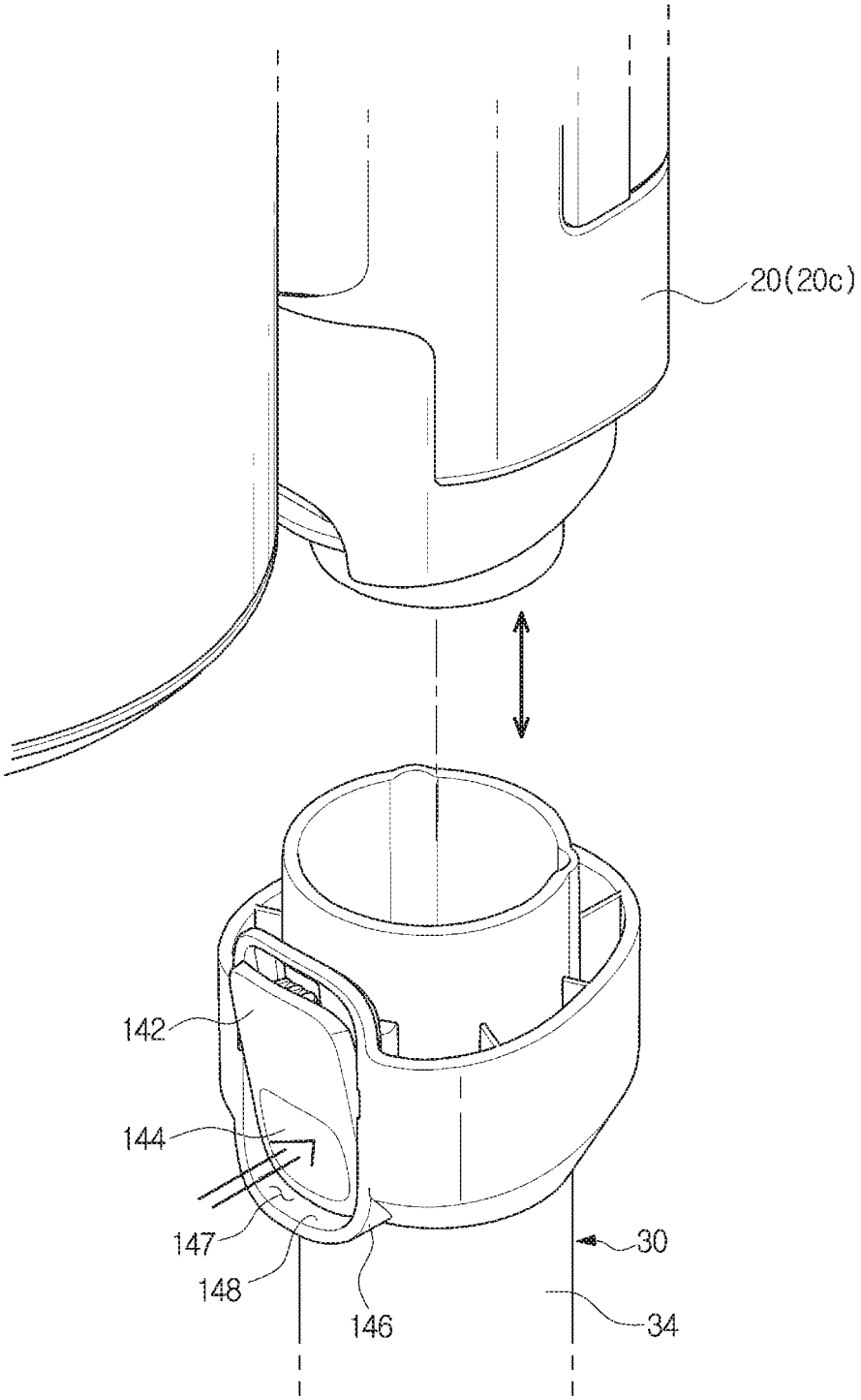
FIG. 17 is a view illustrating a case in which a cleaner body is separated from a suction unit in the cleaning apparatus according to another embodiment of the disclosure.
Figure 18:
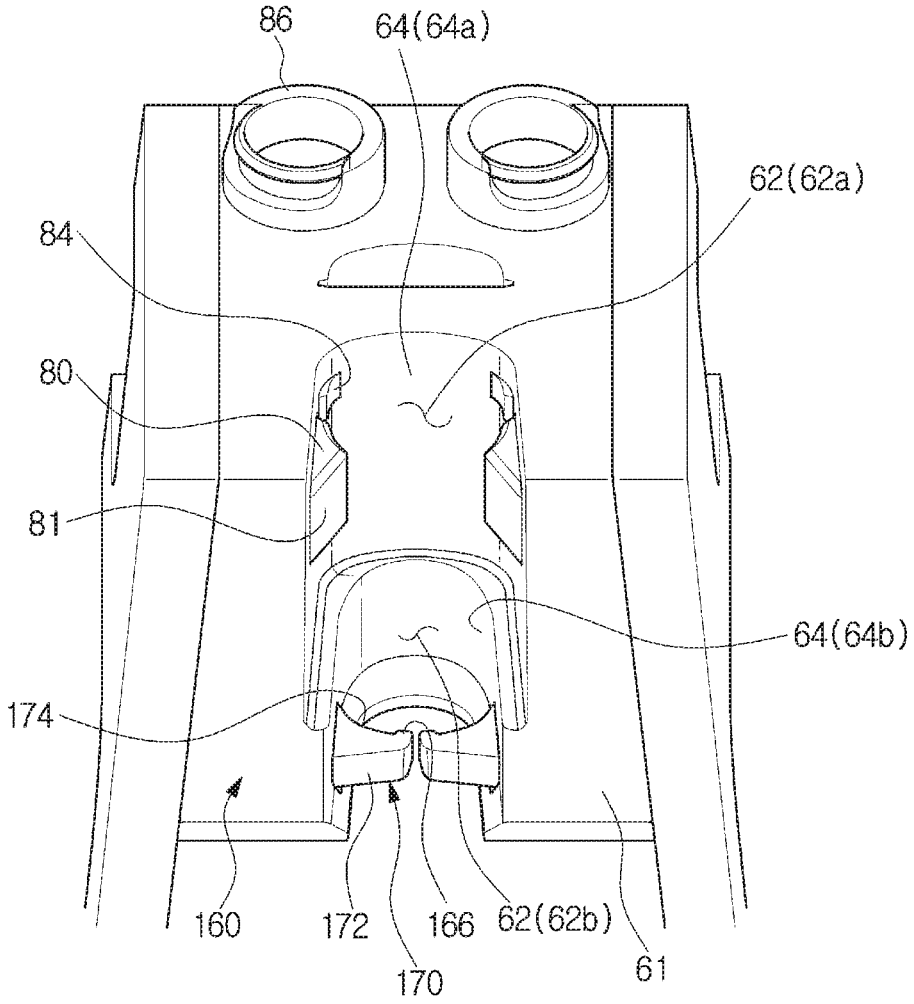
FIG. 18 is a view of a cleaner stand of the cleaning apparatus according to another embodiment of the disclosure.

FIGS. 15 and 16 are perspective views of a cleaning apparatus according to another embodiment of the disclosure, FIG. 17 is a view illustrating a case in which a cleaner body is separated from a suction unit in the cleaning apparatus according to another embodiment of the disclosure, and FIG. 18 is a view of a cleaner stand of the cleaning apparatus according to another embodiment of the disclosure.

As illustrated in FIG. 18, a cleaner stand 150 may include a suction unit holder 170. The suction unit holder 170 is provided in a stand body 61 and configured to hold a suction unit 30.

The suction unit holder 170 may be provided on a pipe seating surface 64*b*. The suction unit holder 170 may protrude from the pipe seating surface 64*b* or at least a part of the suction unit holder 170 may be inserted into an insertion hole 64*c* formed in the pipe seating surface 64*b*. The suction unit holder 170 may be operated with the elasticity through an elastic member 178 (refer to FIG. 24). With this configuration, in the process of being mounted on the cleaner stand 150, the suction unit holder 170 is pressed by the outer surface of a cleaner body 20 or the suction unit 30 and thus at least a part of the suction unit holder 170 is inserted into the insertion hole 64*c*. After a cleaner 10 is mounted on the cleaner stand 150, the suction unit holder 170 protrudes from the pipe seating surface 64*b* and then inserted into a holding groove 147 of the suction unit 30.

The cleaner stand 150 may include an unlocking protrusion 166. The unlocking protrusion 166 is configured to be in contact with a release button 142 provided in the cleaner 10 when the cleaner 10 is seated in a receiving space 62. According to the embodiment, a contact protrusion presses a pressing portion 144 of the separation button 142 and thus the locking between the cleaner body 20 and the cleaner body 20 is released by the release button 142.

The unlocking protrusion 166 may be provided in the suction unit holder 170. Particularly, the unlocking protrusion 166 may be configured to protrude rearward from an end portion of the suction unit holder 170. That is, the unlocking protrusion 166 may be configured to protrude from the end portion of the suction unit holder 170 toward the receiving space 62.

As illustrated in FIGS. 16 and 17, the release button 142 may be located on a side opposite to a direction in which the cleaner 10 is inserted into the receiving space 62. When the cleaner 10 is inserted into the cleaner stand 150, the suction unit holder 170 elastically returns to its original position, and the unlocking protrusion 166 formed at the end of the suction unit holder 170 presses the release button 142 positioned in the cleaner 10. With this operation, the cleaner body 20 is switched from the coupled state 20*a* into the separable state 20*b* while the cleaner 10 is mounted on the cleaner stand 150.

The release button 142 may form a holding groove 147 by being pressed by the unlocking protrusion 166. That is, the unlocking protrusion 166 may be inserted into the holding groove 147 while simultaneously pressing the release button 142.

The cleaner 10 may include a button border 146 surrounding at least a portion of the circumference of the release button 142. The button border 146 forms the holding groove 147 based on a pressure applied to the release button 142 by the unlocking protrusion 166.

Figure 19:
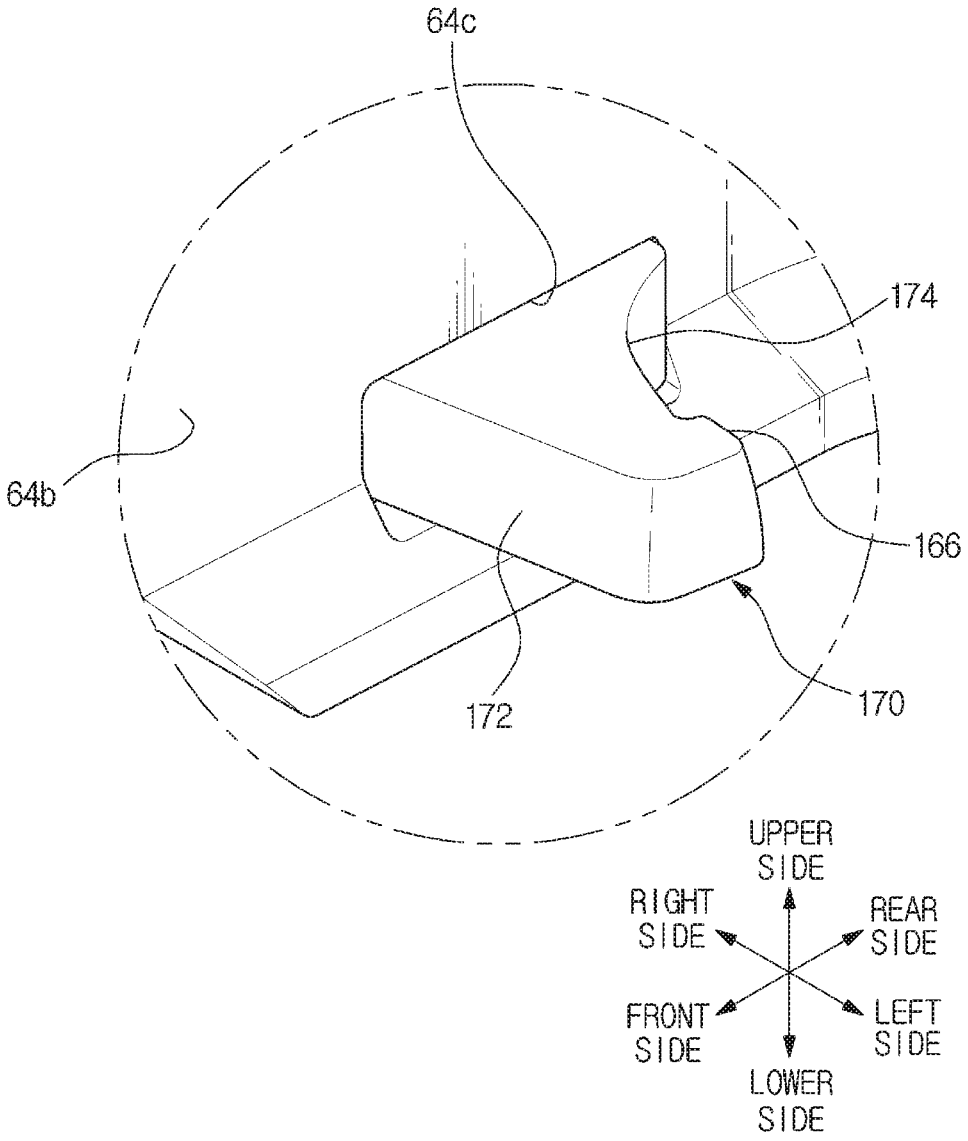
FIG. 19 is an enlarged perspective view of a suction unit holder in the cleaning apparatus according to another embodiment of the disclosure.
Figure 20:
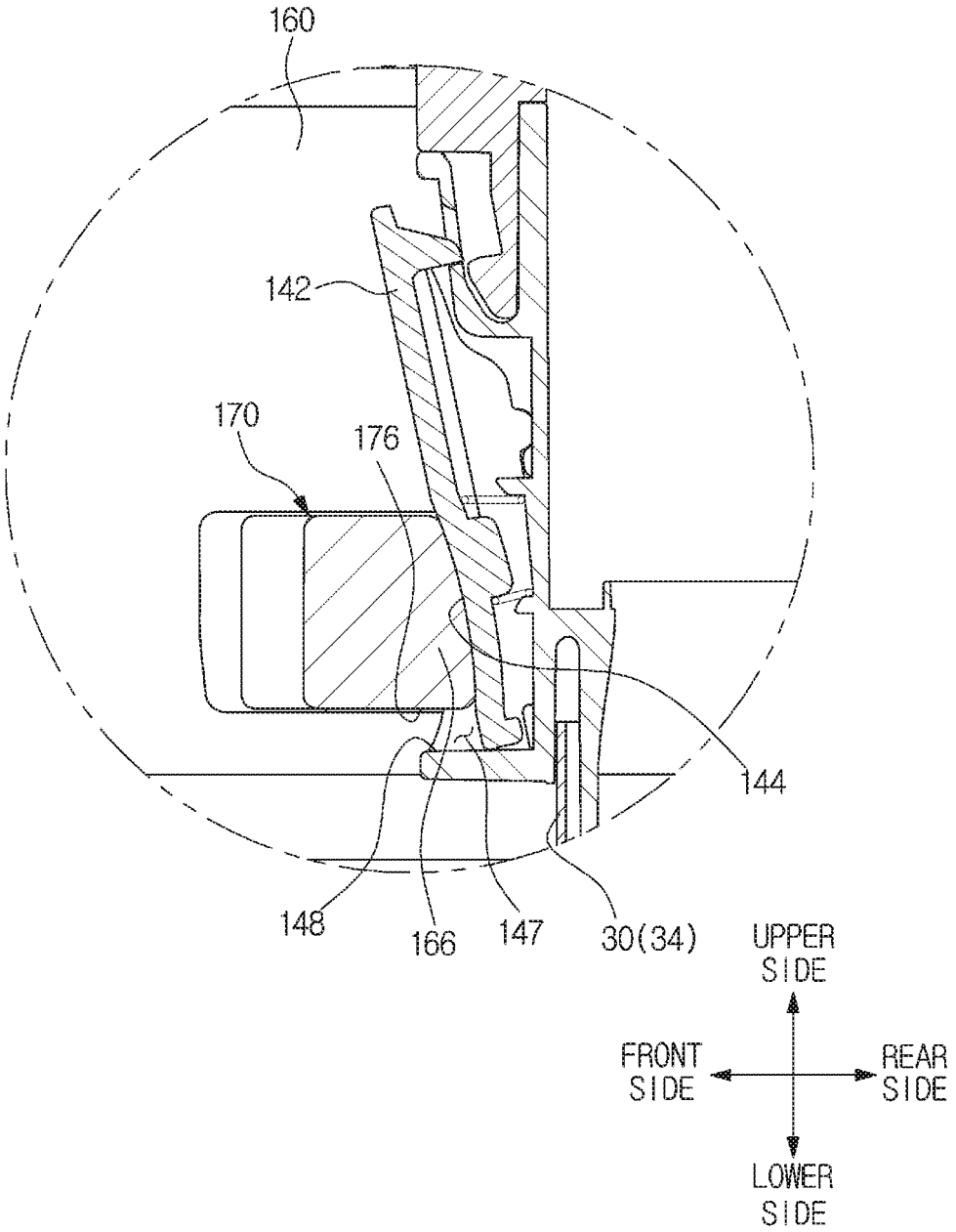
FIG. 20 is a cross-sectional view of the suction unit holder inserted into the cleaner in the cleaning apparatus according to an embodiment of the disclosure.

FIG. 19 is an enlarged perspective view of a suction unit holder in the cleaning apparatus according to another embodiment of the disclosure and FIG. 20 is a cross-sectional view of the suction unit holder inserted into a cleaner in the cleaning apparatus according to another embodiment of the disclosure.

The suction unit holder 170 may include a mounting guide 172.

When the cleaner 10 is mounted on the cleaner stand 150, the mounting guide 172 of the suction unit holder 170 may be pressed by the outer surface of the cleaner 10. At least one part of the suction unit holder 170 may be inserted into the insertion hole 64*c* by being pressed by the outer surface of the cleaner 10. Particularly, the suction unit holder 170 may be pressed by the outer surface of the suction unit 30.

In the suction unit holder 170, the mounting guide 172 may be inclined to be close to the pipe seating surface 64*b* as the mounting guide 172 becomes closer to the front end. Particularly, the mounting guide 172 may be inclined from a protruding portion, which is the most protruded from the pipe seating surface 64*b*, to be close to the pipe seating surface 64*b* as the mounting guide 172 becomes closer to the front end.

The suction unit holder 70 may include a separation guide 174.

When the cleaner 10, which is mounted on the cleaner stand 150, is separated from the cleaner stand 150, the separation guide 174 of the suction unit holder 170 is pressed by the cleaner 10 to allow at least a part of the suction unit holder 170 to be inserted into the insertion hole 64*c*.

By corresponding to a direction in which the cleaner 10 is separated from the front side of the cleaner stand 150, the separation guide 174 may be inclined to be close to the pipe seating surface 64*b* as the separation guide 174 becomes closer to the rear end. Particularly, the separation guide 174 may be inclined from a protruding portion to be close to the pipe seating surface 64*b* as the separation guide 174 becomes closer to the rear end.

The suction unit holder 70 may include a stopper surface 176 (refer to FIG. 20).

The stopper surface 176 allows the suction unit holder 170 to restrict the movement of the suction unit 30 when the cleaner 10 mounted on the cleaner stand 150 is separated from the cleaner stand 150.

The stopper surface 176 may form the lower surface of the suction unit holder 170. Particularly, the stopper surface 176 may form the lower surface of the unlocking protrusion 166. The stopper surface 176 may be formed with a plane perpendicular to the vertical direction. The stopper surface 176 of the suction unit holder 170 is directed downward and a movement restricting surface 148 forming the lower portion of the holding groove 147 is directed upward. The stopper surface 176 is in contact with the movement restricting surface 148 when the suction unit holder 170 is inserted into the holding groove 147, and thus the stopper surface 176 is configured to prevent the upward movement of the suction unit 30.

Hereinafter the operation of mounting or separating the cleaner on or from the cleaning apparatus according to another embodiment of the disclosure will be described.

First, an operation of mounting the cleaner 10 on the cleaner stand 150 will be described.

Figure 21:
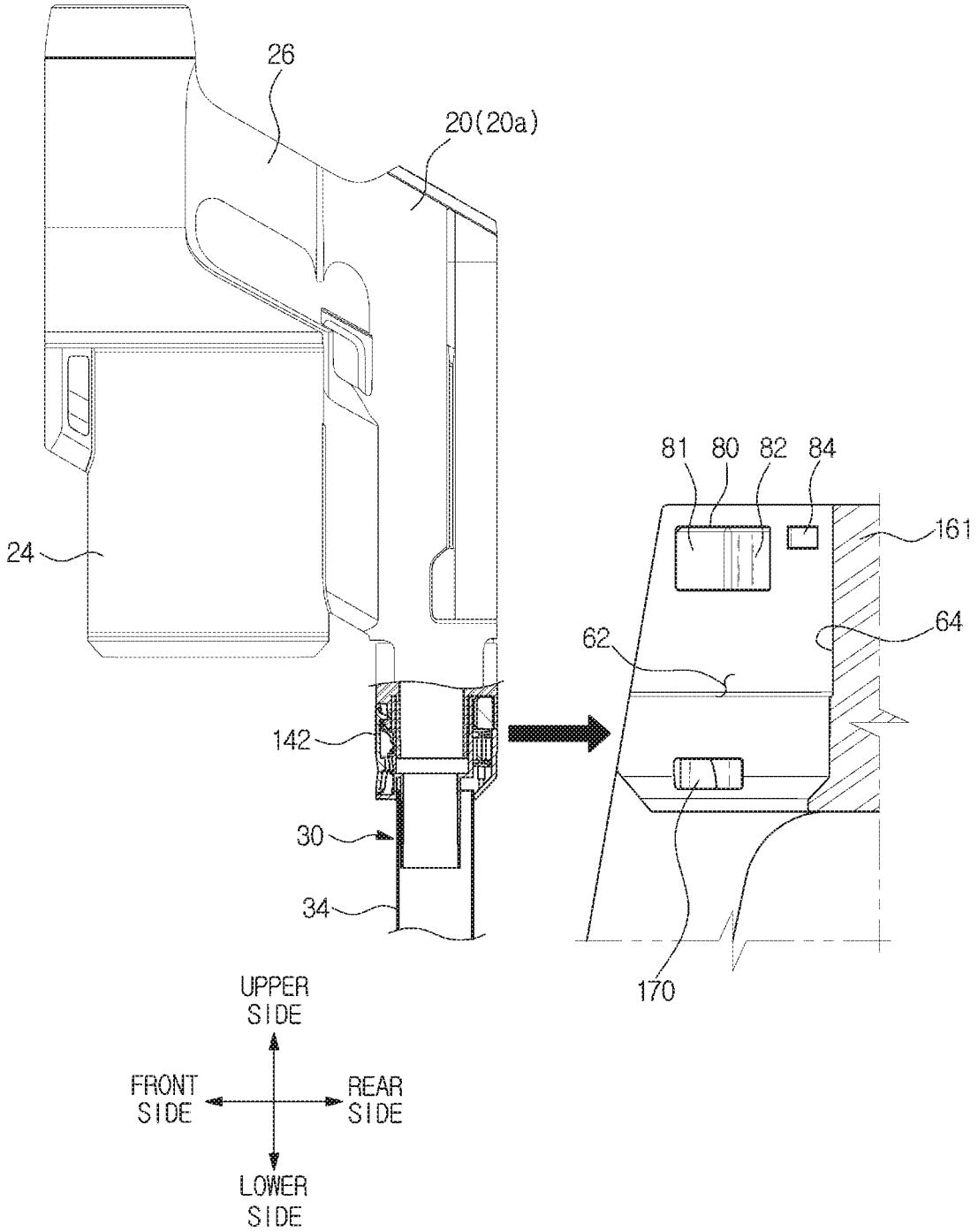
FIG. 21 is a view illustrating a case in which the cleaner is mounted to the cleaner stand in the cleaning apparatus according to an embodiment of the disclosure.

FIG. 21 is a view illustrating a case in which the cleaner is mounted to the cleaner stand in the cleaning apparatus according to an embodiment of the disclosure.

The cleaner 10 may be mounted on the cleaner stand 150 in a state where the cleaner body 20 and the suction unit 30 are locked to each other. That is, the cleaner body 20 in the coupled state 20*a* may be mounted on the receiving space 62 of the cleaner stand 150.

The cleaner 10 may be mounted in the forward direction, the upward direction or the diagonal direction between the forward direction and the upward direction with respect to the cleaner stand 150. FIG. 21 illustrates that the cleaner 10 is mounted in the forward direction of the cleaner stand 150, but is not limited thereto. The cleaner 10 may be mounted in the cleaner stand 150 in the upward direction or the diagonal direction.

During the cleaner 10 is mounted to the cleaner stand 150, the mounting guide 172 of the suction unit holder 170 is elastically inserted into the seating surface 64 by being pressed by the outer surface of the cleaner 10. When the cleaner 10 is mounted on the cleaner stand 150, the suction unit holder 170 elastically returns to its original position and the unlocking protrusion 166 is inserted into the holding groove 147 by pressing the release button 142.

Next, a state in which the cleaner 10 is mounted on the cleaner stand 150 will be described.

Figure 22:
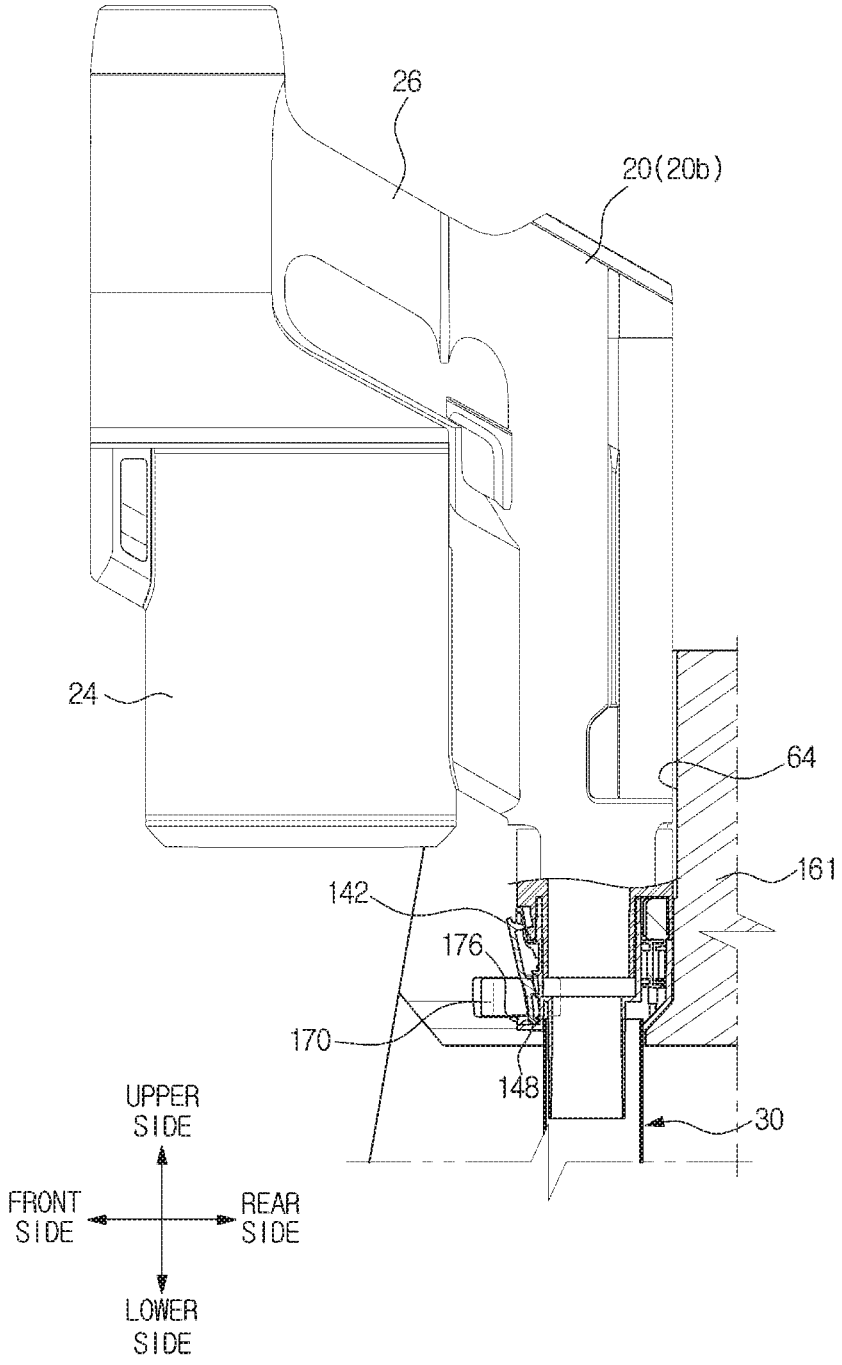
FIGS. 22, 23 and 24 are views illustrating a relationship between the cleaner and the cleaner stand when the cleaner is mounted to the cleaner stand, in the cleaning apparatus according to an embodiment of the disclosure.
Figure 23:
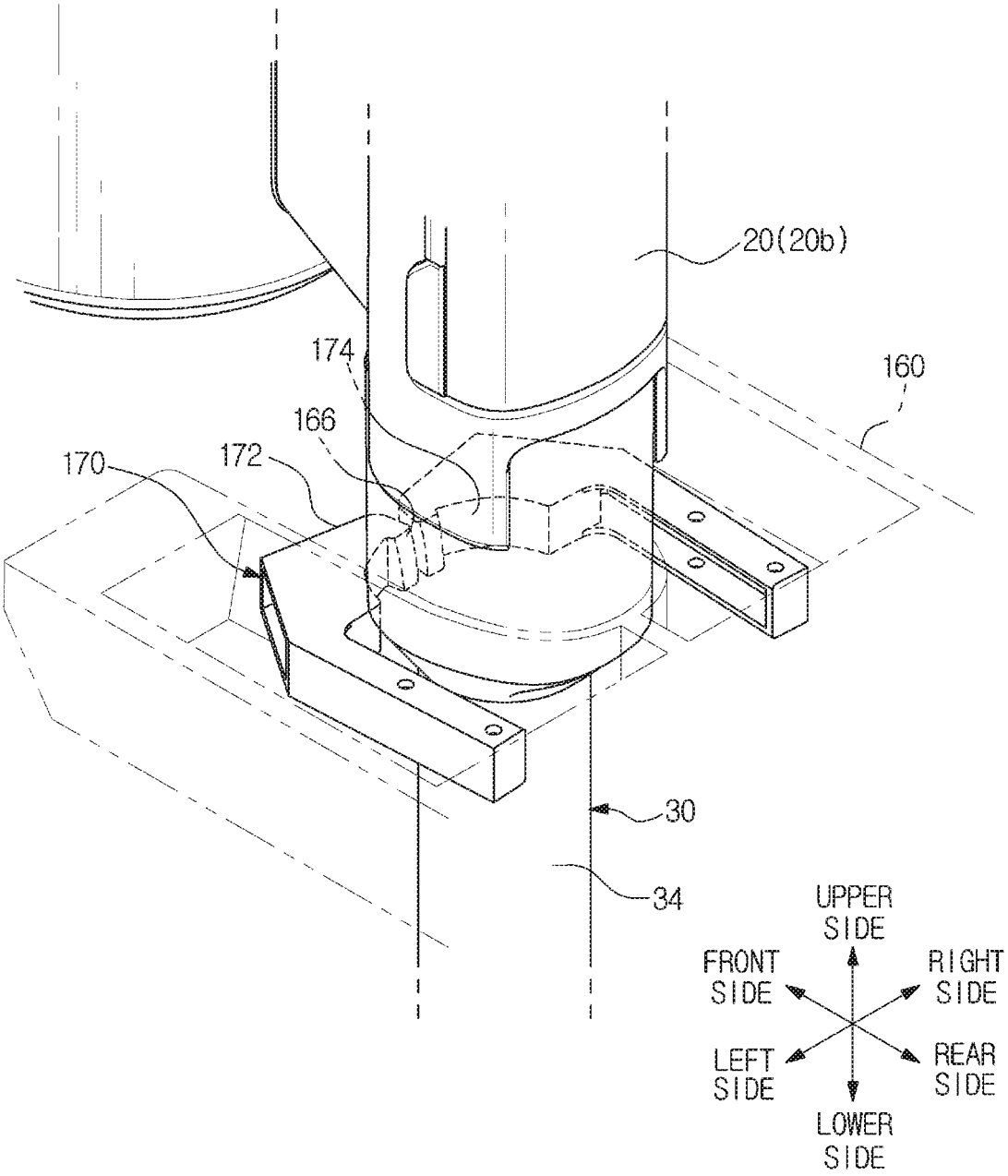
Figure 24:
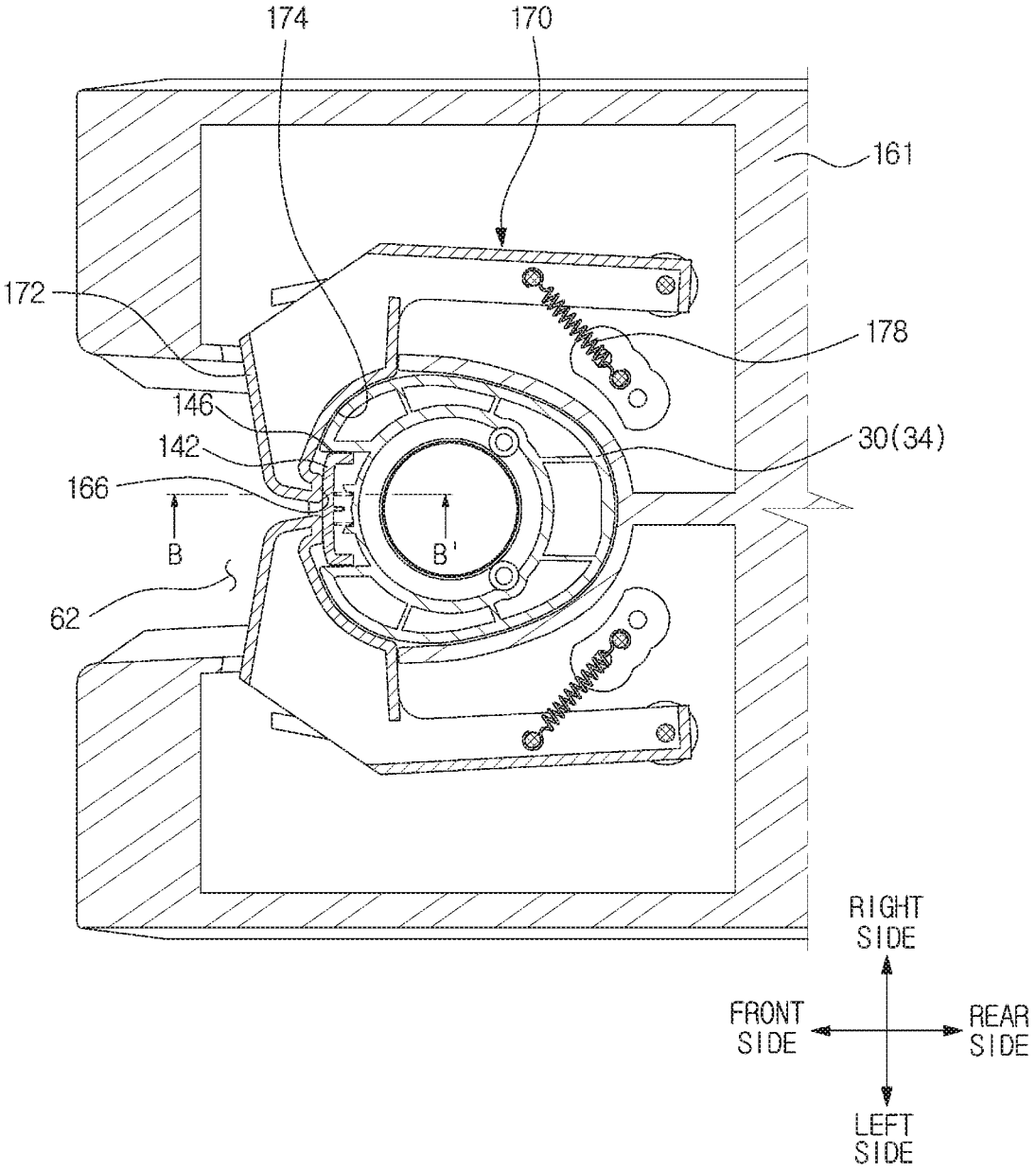

FIGS. 22 to 24 are views illustrating a relationship between the cleaner and the cleaner stand when the cleaner is mounted to the cleaner stand, in the cleaning apparatus according to an embodiment of the disclosure.

When the cleaner 10 is mounted on the cleaner stand 150, the release button 142 is operated to allow the cleaner body 20 and the suction unit 30 to be separable. That is, the cleaner body 20 is switched from the coupled state 20*a* into the separable state 20*b*. As the cleaner 10 is mounted on the cleaner stand 150, the release button 142 of the cleaner 10 is operated by being in contact with the unlocking protrusion 166 or by being pressed by the unlocking protrusion 66, as illustrated in FIG. 22. Therefore, the locking between the cleaner body 20 and the suction unit 30 is released. In addition, the unlocking protrusion 66 formed in the end portion of the suction unit holder 170 is inserted into the holding groove 147 generated by the pressure of the release button 142.

Next, an operation of separating the cleaner 10 from the cleaner stand 150 will be described. The separation will be described with reference to the above mentioned drawings.

When the cleaner 10 is separated frontward from the cleaner stand 150, the cleaner 10 is separated by pushing the suction unit holder 170, and the unlocking protrusion 166 releases the pressure applied to the release button 142. That is, the release button 142 is separated from the unlocking protrusion 166. The release button 142 locks the cleaner body 20 to the suction unit 30 again. The cleaner body 20 is switched from the separable state 20*b* into the coupled state 20*a*.

When the cleaner body 20 is separated upward from the cleaner stand 150, the movement restricting surface 148 of the suction unit 30 is in contact with the stopper surface 176 and restricts the movement of the suction unit 30. That is, the cleaner body 20 is separated from the suction unit 30 and thus the cleaner body 20 operates in the separated state 20*c*.

As for the direction in which the cleaner body 20 is separated, the forward direction may be defined as a first direction and the upward direction may be defined as a second direction. However, the first and second directions are not limited to the forward direction and the upward direction. Therefore, the first and second directions may vary according to the arrangement of the stopper surface 176, the suction unit holder 170, the unlocking protrusion 166 or the release button 142. According to the embodiment, the first direction corresponds to the forward direction from the cleaner stand 150, but is not limited thereto. The first direction may include the diagonal direction between the forward direction and the upward direction.

Hereinafter a cleaning apparatus according to another embodiment of the disclosure will be described.

In the description, the same elements as those described above will not be described again. In this embodiment, a separation button position of a cleaner, a suction unit holder, and an unlocking protrusion are different from those of the above-described embodiment.

Figure 25:
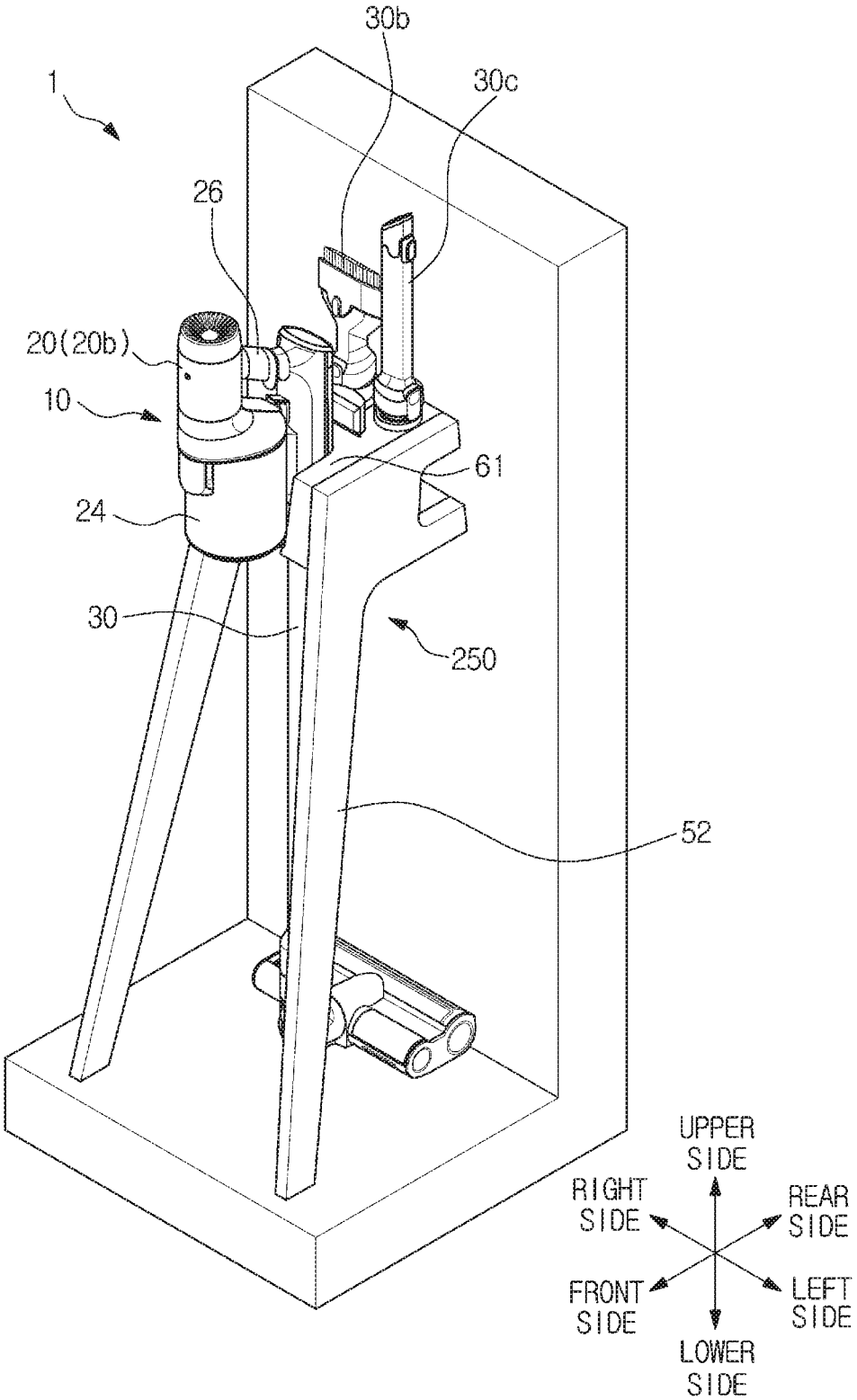
FIGS. 25 and 26 are perspective views of a cleaning apparatus according to yet another embodiment of the disclosure.
Figure 26:
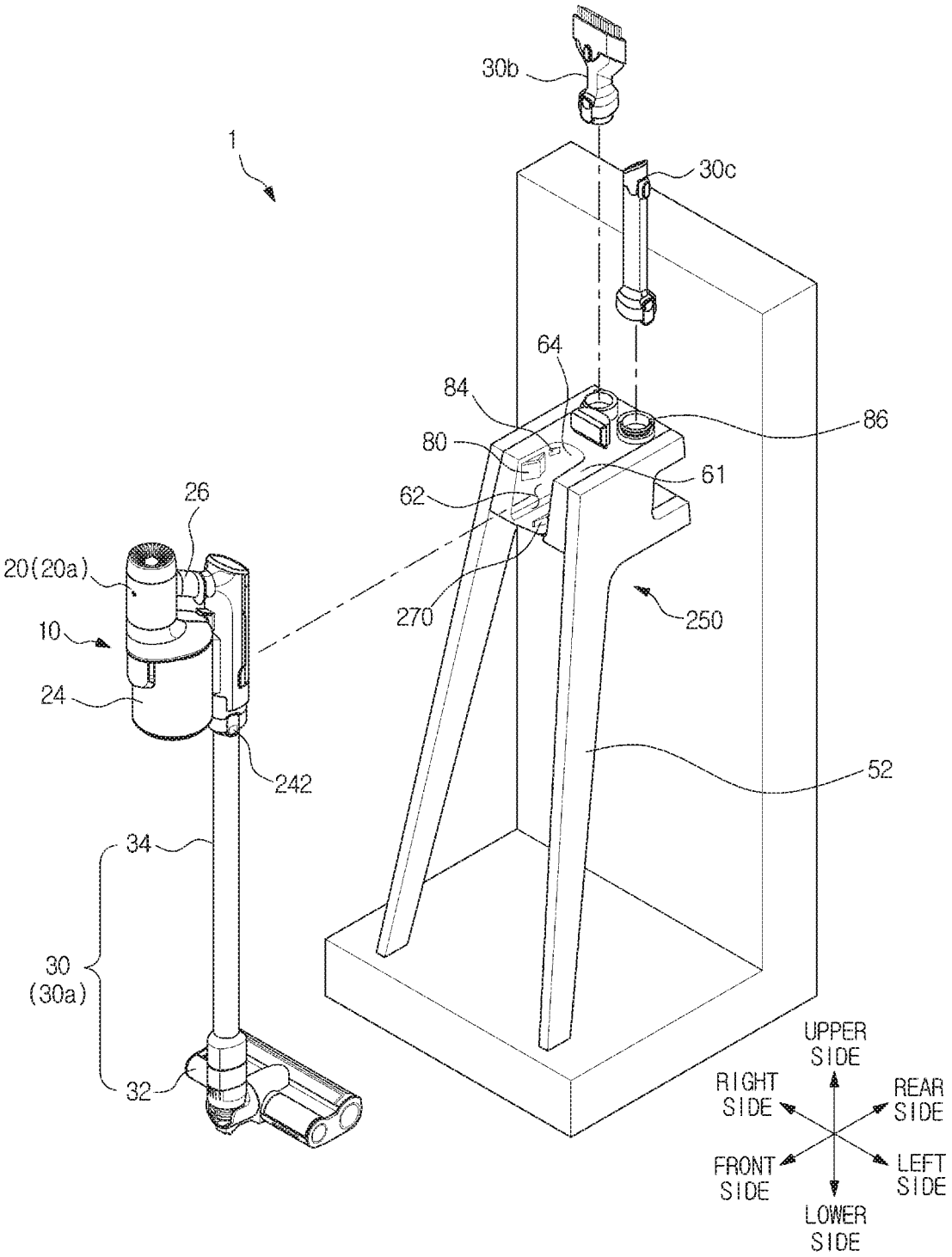
Figure 27:
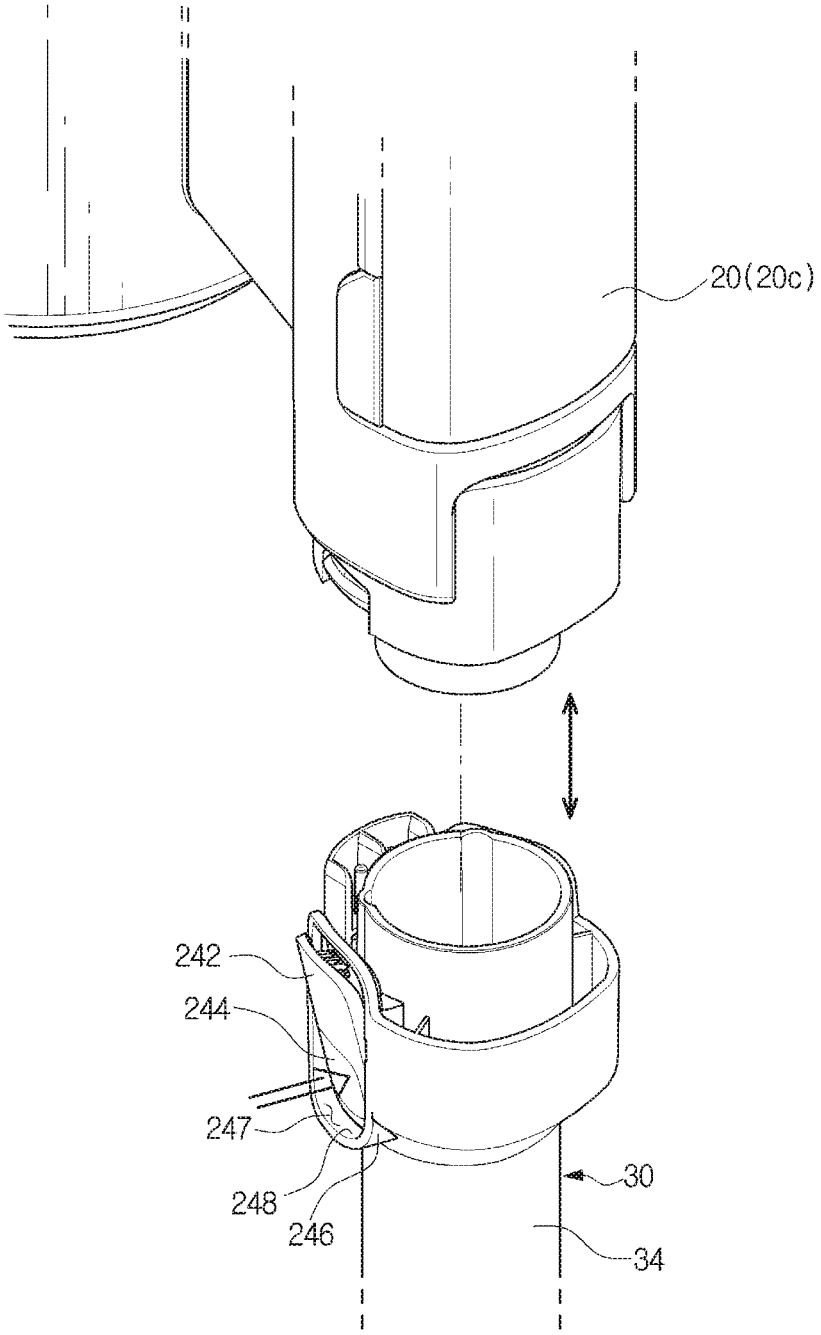
FIG. 27 is a view illustrating a case in which a cleaner body is separated from a suction unit in the cleaning apparatus according to yet another embodiment of the disclosure.
Figure 28:
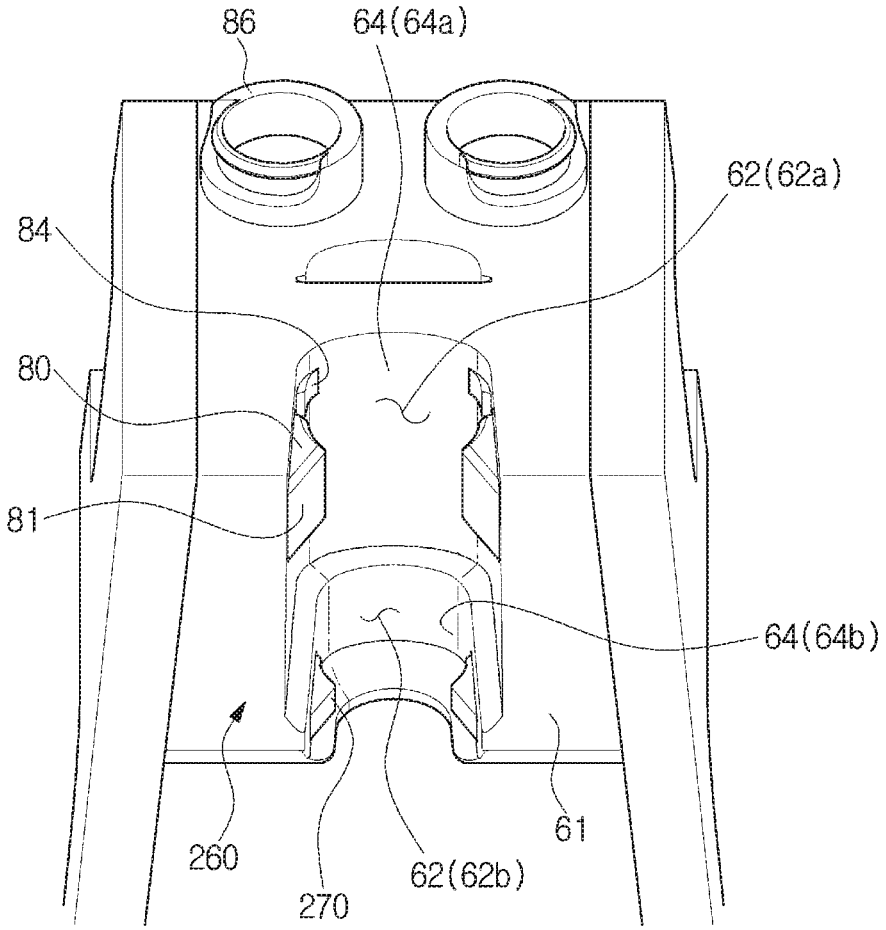
FIG. 28 is a view of a cleaner stand of the cleaning apparatus according to yet another embodiment of the disclosure.
Figure 29:
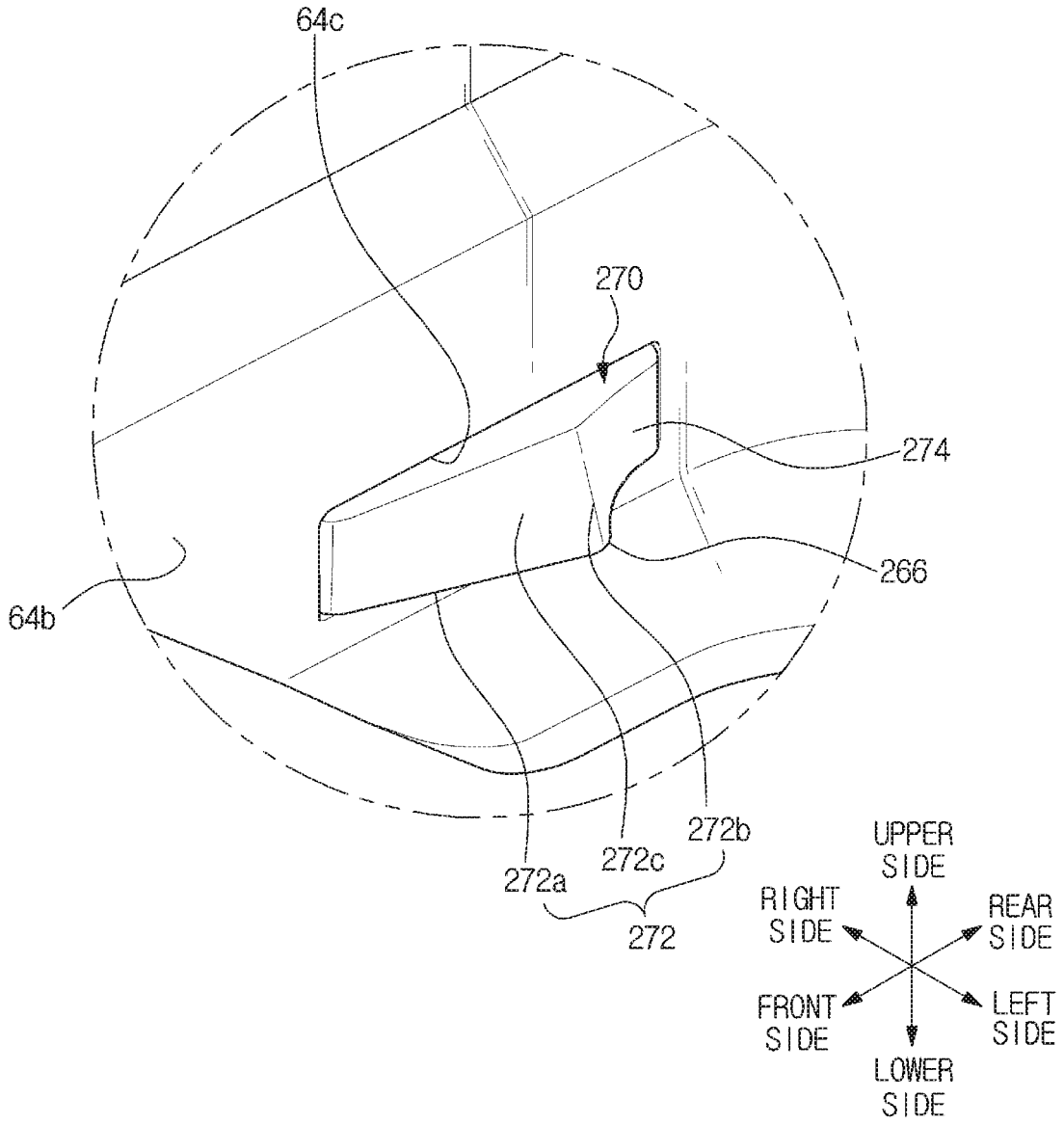
FIG. 29 is an enlarged perspective view of a suction unit holder in the cleaning apparatus according to yet another embodiment of the disclosure.
Figure 30:
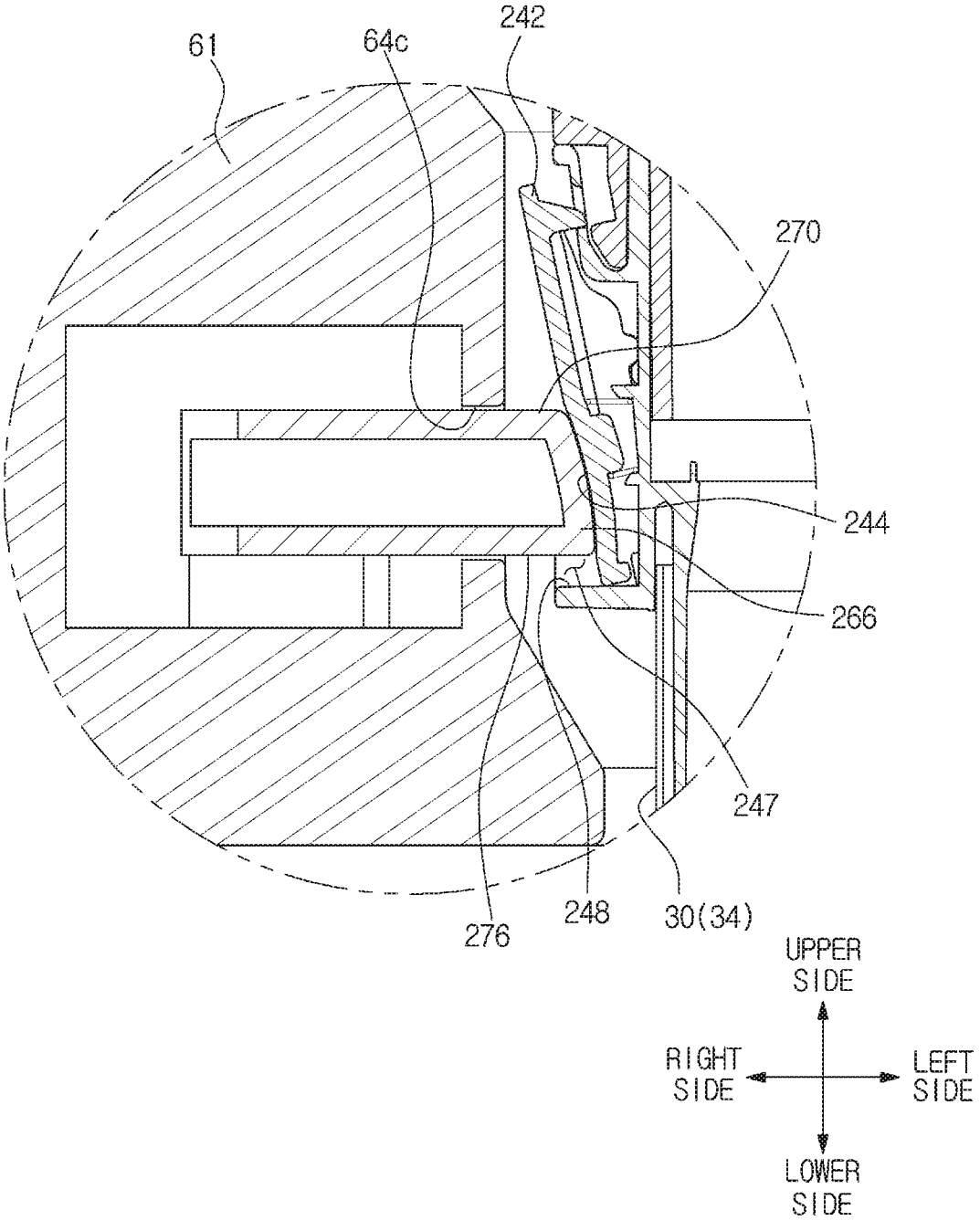
FIG. 30 is a cross-sectional view of the suction unit holder inserted into a cleaner in the cleaning apparatus according to an embodiment of the disclosure.

FIGS. 25 and 26 are perspective views of a cleaning apparatus according to yet another embodiment of the disclosure, FIG. 27 is a view illustrating a case in which a cleaner body is separated from a suction unit in the cleaning apparatus according to yet another embodiment of the disclosure, FIG. 28 is a view of a cleaner stand of the cleaning apparatus according to yet another embodiment of the disclosure, FIG. 29 is an enlarged perspective view of a suction unit holder in the cleaning apparatus according to yet another embodiment of the disclosure and FIG. 30 is a cross-sectional view of the suction unit holder inserted into a cleaner in the cleaning apparatus according to an embodiment of the disclosure.

A cleaner stand 250 may include a suction unit holder 270. The suction unit holder 270 is provided in a stand body 61 and configured to hold the suction unit 30. Particularly, a holding groove 247 may be formed on one side of the suction unit 30, and the suction unit holder 270 may be inserted into a holding groove 247. The suction unit holder 270 may be provided on a pipe seating surface 64*b*.

The cleaner stand 250 may include an unlocking protrusion 266. The unlocking protrusion 266 is configured to be in contact with a release button 242 provided in the cleaner 10 when the cleaner 10 is mounted on a receiving space 62. According to the embodiment, the unlocking protrusion 266 presses a pressing portion 244 of the release button 242 and thus the locking between the cleaner body 20 and the suction unit 30 is released by the release button 242.

The unlocking protrusion 266 may be provided in the suction unit holder 270. The unlocking protrusion 266 may form a protrusion of the suction unit holder 270. That is, the unlocking protrusion 266 may be contained in the suction unit holder 270, thereby forming a part of the suction unit holder 270. According to the embodiment, the unlocking protrusion 266 is configured to correspond to the protrusion 71 of FIG. 7A, but is not limited thereto. Alternatively, a plurality of protrusions may be formed in the suction unit holder 270 and at least one of the protrusions may serve as the unlocking protrusion 266.

The release button 242 may be positioned on both sides of the cleaner 10. Particularly, the release button 242 may be positioned on both sides of the suction unit 30. According to the embodiment, a pair of the release buttons 242 is provided such that a single release button 242 is positioned on one of the both sides of the suction unit 30 and the other thereof is positioned on the other side of the suction unit 30, but is not limited thereto. Alternatively, a single release button 242 may be positioned on only one side of the suction unit 30.

The release button 242 may form the holding groove 247 by being pressed by the unlocking protrusion 266 provided in the suction unit holder 270. That is, the unlocking protrusion 266 may be inserted into the holding groove 247 while simultaneously pressing the release button 242.

The cleaner 10 may include a button border 246 surrounding at least a portion of the circumference of the release button 242. The button border 246 forms the holding groove 247 when the release button 242 is pressed by the unlocking protrusion 266.

The suction unit holder 270 may include a stopper surface 276 (refer to FIG. 30).

The stopper surface 276 allows the suction unit holder 270 to restrict the movement of the suction unit 30 when the cleaner 10 mounted on the cleaner stand 250 is separated from the cleaner stand 250.

The stopper surface 276 may form the lower surface of the suction unit holder 270. The stopper surface 276 may be formed with a plane perpendicular to the vertical direction. The stopper surface 276 of the suction unit holder 270 is directed downward, and a movement restricting surface 248 forming the lower portion of the holding groove 247 is directed upward. The stopper surface 276 is in contact with the movement restricting surface 248 when the suction unit holder 270 is inserted into the holding groove 247, and thus the stopper surface 276 is configured to prevent the upward movement of the suction unit 30.

Hereinafter the operation of mounting or separating the cleaner on or from the cleaning apparatus according to yet another embodiment of the disclosure will be described.

First, an operation of mounting the cleaner 10 on the cleaner stand 250 will be described.

Figure 31:
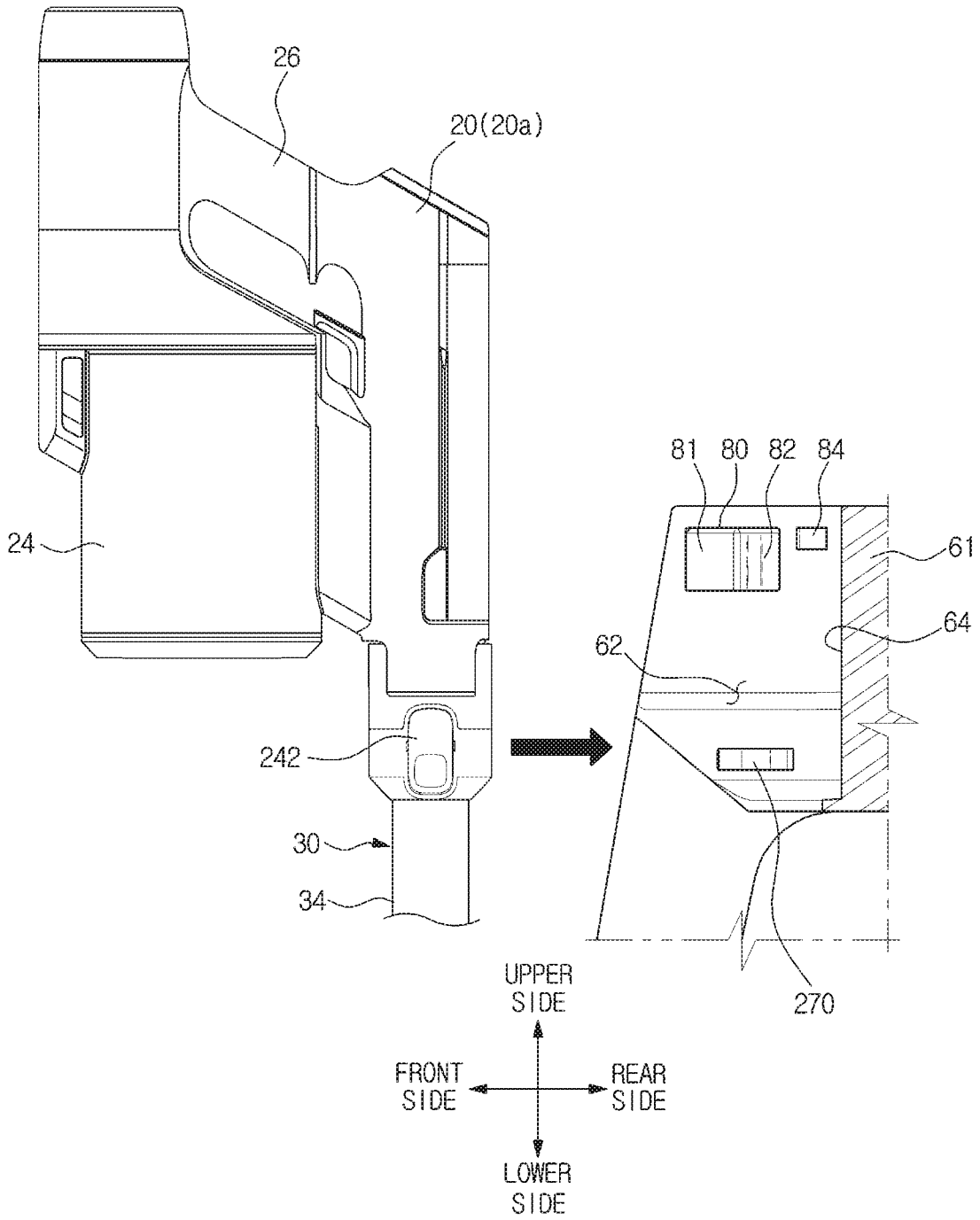
FIG. 31 is a view illustrating a case in which the cleaner is mounted to the cleaner stand in the cleaning apparatus according to an embodiment of the disclosure.

FIG. 31 is a view illustrating a case in which the cleaner is mounted to the cleaner stand in the cleaning apparatus according to an embodiment of the disclosure.

The cleaner 10 may be mounted on the cleaner stand 250 in a state where the cleaner body 20 and the suction unit 30 are locked to each other. That is, the cleaner body 20 in the coupled state 20*a* may be mounted on the receiving space 62 of the cleaner stand 250.

The cleaner 10 may be mounted in the forward direction, the upward direction or the diagonal direction between the forward direction and the upward direction with respect to the cleaner stand 250. FIG. 31 illustrates that the cleaner 10 is mounted in the forward direction of the cleaner stand 250, but is not limited thereto. The cleaner 10 may be mounted on the cleaner stand 250 in the upward direction or the diagonal direction.

During the cleaner 10 is mounted to the cleaner stand 250, a mounting guide 272 of the suction unit holder 270 is elastically inserted into a seating surface 64 by the pressure of the outer surface of the cleaner 10. When the cleaner 10 is mounted on the cleaner stand 250, the suction unit holder 270 elastically returns to its original position and the unlocking protrusion 266 is inserted into the holding groove 247 by pressing the release button 242.

Next, a state in which the cleaner 10 is mounted on the cleaner stand 250 will be described.

Figure 32:
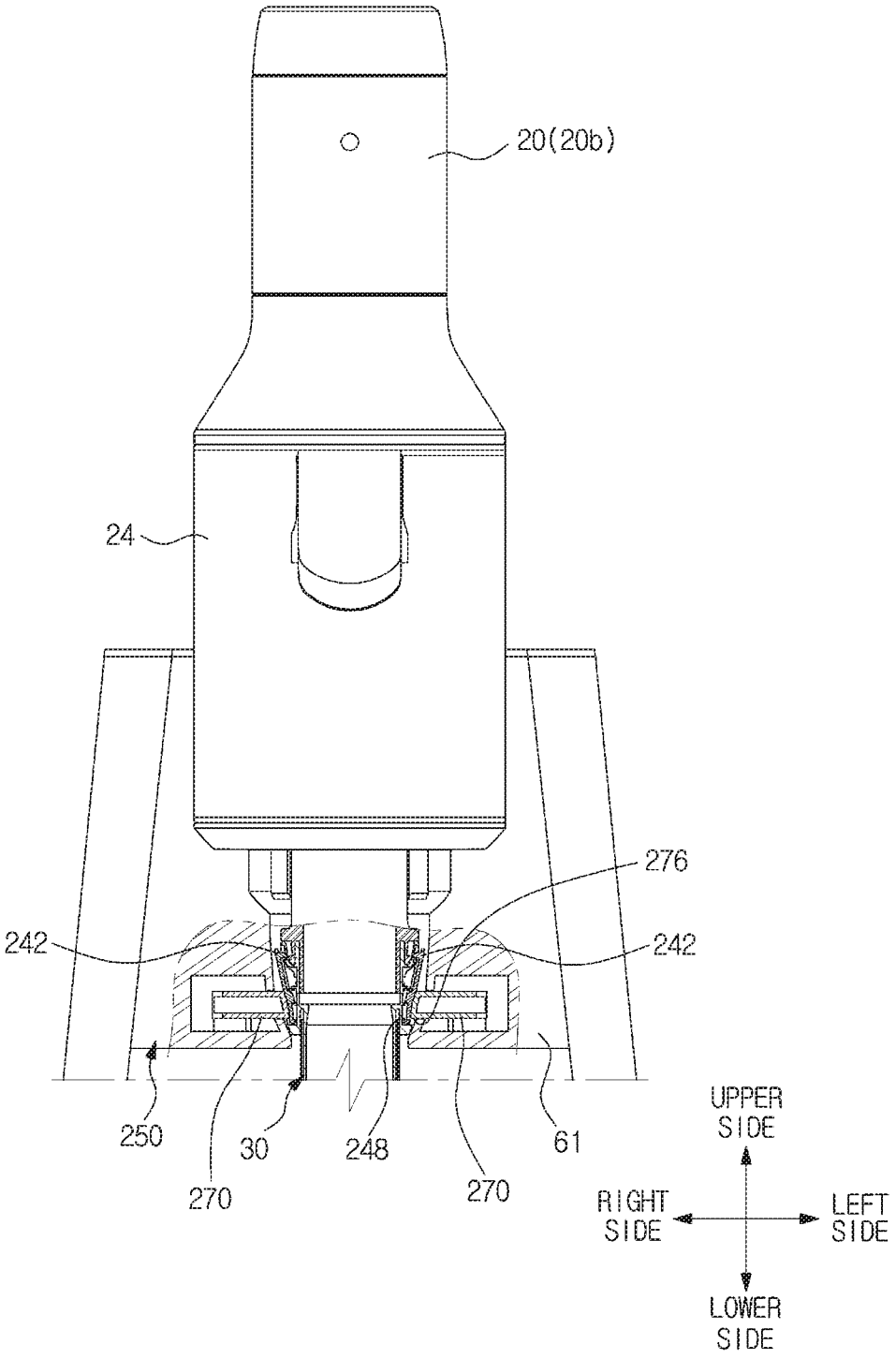
FIGS. 32, 33 and 34 are views illustrating a relationship between the cleaner and the cleaner stand when the cleaner is mounted to the cleaner stand, in the cleaning apparatus according to an embodiment of the disclosure.
Figure 33:
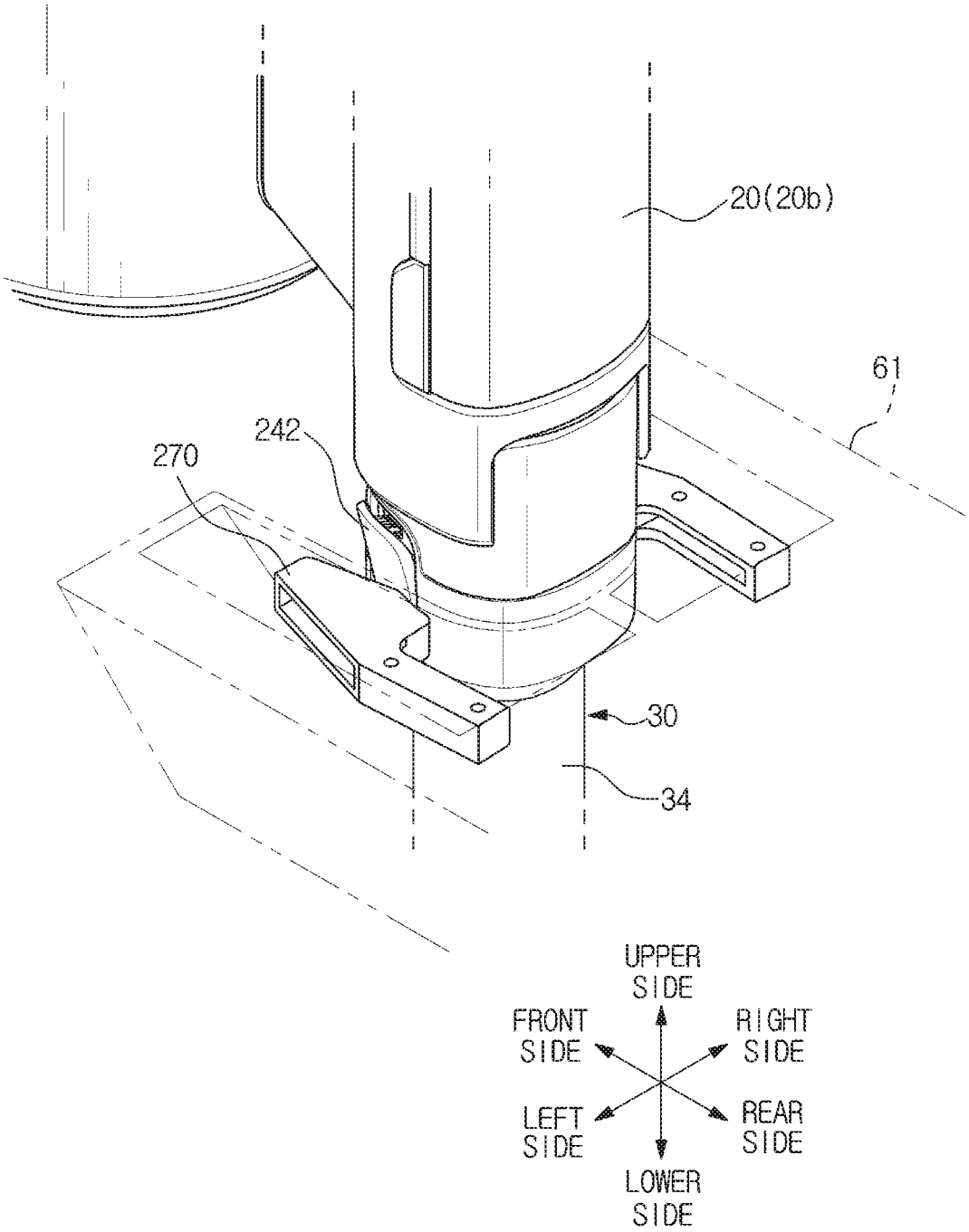
Figure 34:
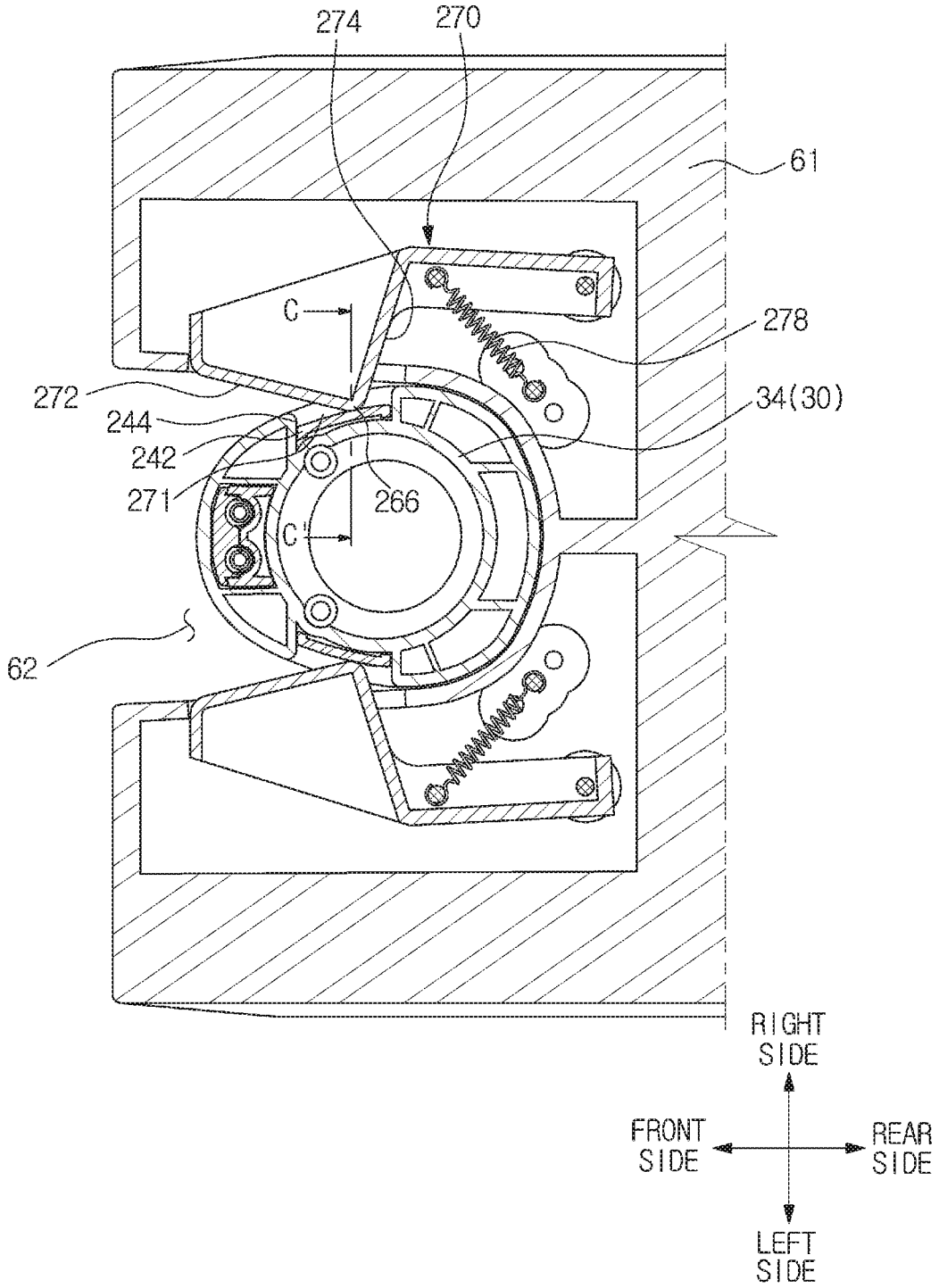

FIGS. 32 to 34 are views illustrating a relationship between the cleaner and the cleaner stand when the cleaner is mounted to the cleaner stand, in the cleaning apparatus according to an embodiment of the disclosure.

When the cleaner 10 is mounted on the cleaner stand 250, the release button 242 is operated to allow the cleaner body 20 and the suction unit 30 to be separable. That is, the cleaner body 20 is switched from the coupled state 20*a* into the separable state 20*b*. As the cleaner 10 is mounted on the cleaner stand 250, the release button 242 of the cleaner 10 is operated by being in contact with the unlocking protrusion 266 or by being pressed by the unlocking protrusion 266, as illustrated in FIGS. 32 to 34. Therefore, the locking between the cleaner body 20 and the suction unit 30 is released. In addition, the unlocking protrusion 266 is inserted into the holding groove 247 of the cleaner 10.

Next, an operation of separating the cleaner 10 from the cleaner stand 250 will be described. The separation will be described with reference to the above mentioned drawings.

When the cleaner 10 is separated frontward from the cleaner stand 250, the cleaner 10 is separated by pushing the suction unit holder 270, and the unlocking protrusion 266 releases the pressure applied to the release button 242. That is, the release button 242 is apart from the unlocking protrusion 266. The release button 242 locks the cleaner body 20 to the suction unit 30 again. The cleaner body 20 is switched from the separable state 20*b* into the coupled state 20*a*.

When the cleaner body 20 is separated upward from the cleaner stand 250, the movement restricting surface 248 of the suction unit 30 is in contact with the stopper surface 276 and restricts the movement of the suction unit 30. That is, the cleaner body 20 is separated from the suction unit 30 and thus the cleaner body 20 operates in the separated state 20*c*.

As for the direction in which the cleaner body 20 is separated, the forward direction may be defined as a first direction and the upward direction may be defined as a second direction. However, the first and second directions are not limited to the forward direction and the upward direction. Therefore, the first and second directions may vary according to the arrangement of the stopper surface 276, the suction unit holder 270, the unlocking protrusion 266 or the release button 242. According to the embodiment, the first direction corresponds to the forward direction from the cleaner stand 250, but is not limited thereto. The first direction may include the diagonal direction between the forward direction and the upward direction.

Hereinafter a cleaning apparatus according to still yet another embodiment of the disclosure will be described.

In the description, the same elements as those described above will not be described again.

Figure 35:
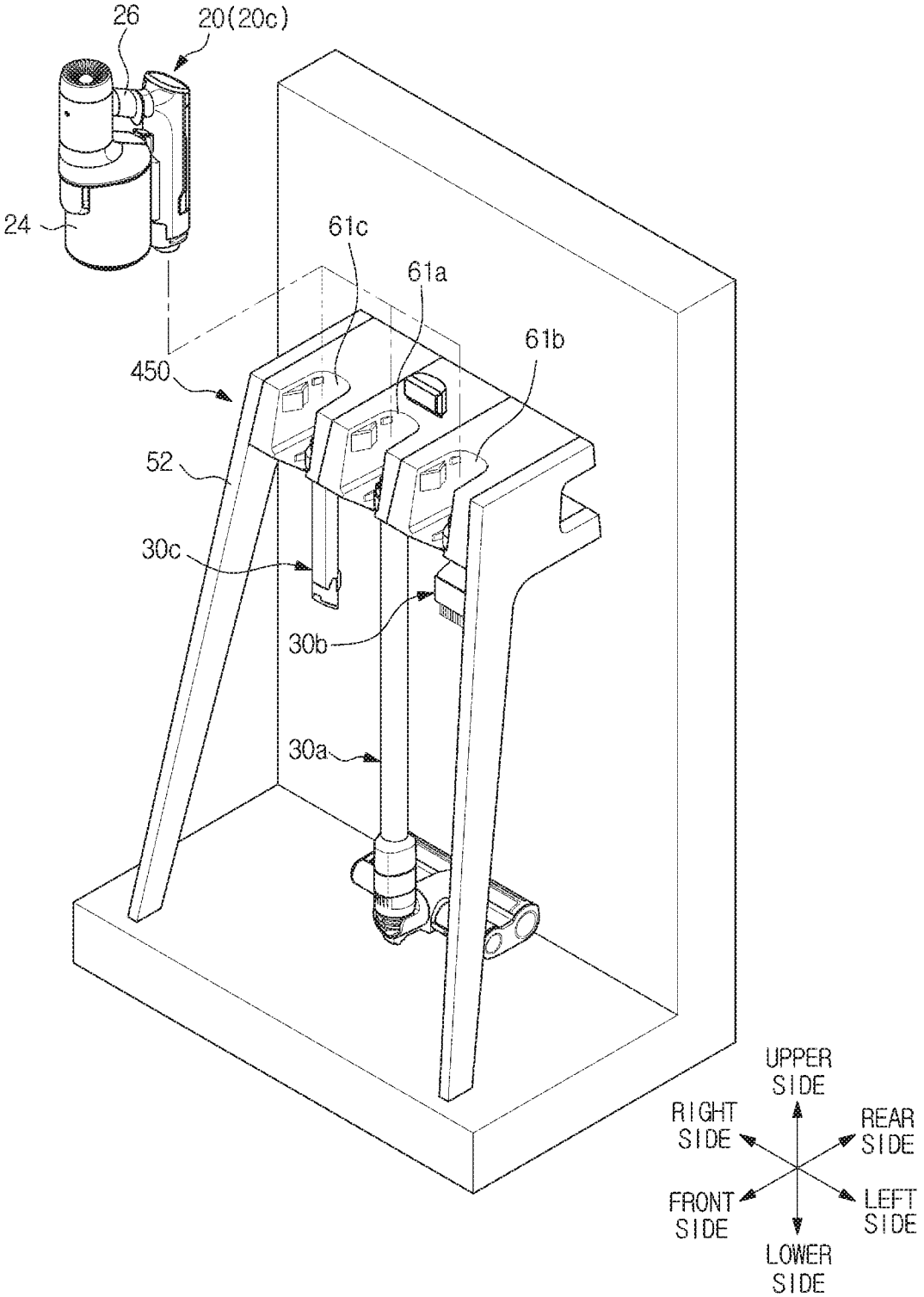
FIG. 35 is a perspective view of a cleaning apparatus according to still yet another embodiment of the disclosure.

FIG. 35 is a perspective view of a cleaning apparatus according to still yet another embodiment of the disclosure.

A cleaner stand 450 may be configured to store or charge a cleaner 10. The cleaner stand 450 may include a plurality of stand bodies 61*a*, 61*b* and 61*c* on which the cleaner 10 is mounted. The cleaner stand 450 may include legs 52 to allow the stand bodies 61*a*, 61*b* and 61*c* to be supported apart from the floor surface. According to the embodiment, the stand bodies 61*a*, 61*b* and 61*c* may lean on the wall surface. The stand bodies 61*a*, 61*b* and 61*c* are configured to be supported apart from the floor surface through a pair of legs 52. As well as, the stand bodies 61*a*, 61*b* and 61*c* is configured to lean on the wall surface, the cleaner stand 450 may be configured to be fixed to the wall surface. However, the shape of the cleaner stand 50 is not limited thereto.

The suction unit 30 may include a first suction unit 30*a* provided with a suction head 32 and an extension pipe 34, a suction unit 30*b* to which a brush is coupled and a suction unit 30*c* including an opening that is narrow to clean a narrow gap.

According to the embodiment, the plurality of stand bodies 61*a*, 61*b* and 61*c* may be provided, and different suction unit 30 may be installed in each of the stand bodies

61*a*, 61*b* and 61*c*. That is, the stand bodies 61*a*, 61*b* and 61*c* may include first, second and third stand bodies 61*a*, 61*b* and 61*c*, and different suction units 30*a*, 30*b* and 30*c* may be installed in the stand bodies 61*a*, 61*b* and 61*c*, respectively.

With this arrangement, it is possible to mount the cleaner body 20 to any one of the first, second and third stand bodies 61*a*, 61*b* and 61*c*, selectively. In addition, it is possible to separate the cleaner body 20 in the coupled state 20*a*, in which any one suction unit among the suction units 30*a*, 30*b* and 30*c* is mounted to the cleaner body 20, or to separate the cleaner body 20 in the separated state 20*c*.

According to the embodiment, it has been illustrated that the stand bodies 61*a*, 61*b* and 61*c* are arranged side by side in the left and right direction, but is not limited thereto. For example, the stand bodies 61*a*, 61*b*, and 61*c* may be arranged in a circular shape and thus directed in different directions.

As is apparent from the above description, it is possible to stably mount the cleaner to the cleaner stand by improving a mounting structure of the cleaner about the cleaner stand.

The suction unit of the cleaner may be easily separated and coupled, thereby providing convenience to the user.

Various types of cleaners may be available by changing directions in which the cleaner is separated from the cleaner stand.

A user may easily select various suction units according to the purpose of use.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaner stand for a cleaner which is mountable to the cleaner stand, the cleaner comprising a cleaner body and a suction unit lockable with the cleaner body, comprising:

a stand body to receive a part of the cleaner therein; and a suction unit holder disposed in the stand body to which the suction unit of the cleaner is mountable, wherein while the cleaner is mounted to the cleaner stand in a mounted state, the cleaner stand is configured to unlock a locking of the cleaner body and the suction unit so that the cleaner body of the cleaner is separable from the suction unit, wherein in a first operating mode, from the mounted state, when the cleaner is separated from the cleaner stand in a first direction, the cleaner stand is configured to lock the cleaner body and the suction unit together by releasing an unlocking of the cleaner body and the suction unit which have been unlocked by the cleaner stand in the mounted state so that the cleaner stand is configured to allow the cleaner, having the suction unit locked with the cleaner body, to be separated from the cleaner stand, and wherein in a second operation mode, from the mounted state, when the cleaner is separated from the cleaner stand in a second direction, the cleaner stand is configured to allow only the cleaner body of the cleaner to be separated from the cleaner stand cleaner while having the suction unit to remain mounted to the suction unit holder.

2. The cleaner stand of claim 1, wherein the cleaner body is configured to be separable from the suction unit when the cleaner body is unlocked with the suction unit in mounted state, in a third operating mode.

3. The cleaner stand of claim 2, wherein:

when the cleaner, from the mounted state, is separated from the cleaner stand in the first direction, the cleaner body is switched from the third operating mode to the first operating mode; and when the cleaner, from the mounted state, is separated from the cleaner in the second direction, the cleaner body is switched from third operating mode to the second operating mode.

4. The cleaner stand of claim 3, wherein the first direction comprises a forward direction with respect to the cleaner stand, and the second direction comprises an upward direction with respect to the cleaner stand.

5. The cleaner stand of claim 3, further comprising:

an unlocking protrusion configured to press a release button of the cleaner when the cleaner is mounted to the cleaner stand and to release a locking of the cleaner body and the suction unit to allow the cleaner body to be operated in the third operating mode, and wherein the unlocking protrusion is configured to restrict a movement of the suction unit in the second direction.

6. The cleaner stand of claim 5, wherein the unlocking protrusion comprises a stopper surface configured to form a lower surface of the unlocking protrusion and configured to be inserted into a groove, which is formed by a pressure applied to the release button, the stopper surface configured to restrict the movement of the suction unit by being in contact with the suction unit when the cleaner is separated in the second direction.

7. The cleaner stand of claim 6, wherein the stopper surface is formed with a plane perpendicular to the second direction.

8. The cleaner stand of claim 5, wherein the stand body is configured to form a receiving space in which the part of the cleaner is received therein, and the unlocking protrusion protrudes from the stand body to the receiving space.

9. The cleaner stand of claim 8, wherein the suction unit holder is configured to be operated in conjunction with a mounting operation or a separating operation of the suction unit about the receiving space.

10. The cleaner stand of claim 9, wherein when the cleaner is mounted to the cleaner stand, the suction unit holder corresponds to a portion apart from a portion corresponding to the unlocking protrusion in the cleaner.

11. The cleaner stand of claim 9, wherein the suction unit holder together with the unlocking protrusion restricts the movement of the suction unit when the cleaner is separated in the second direction.

12. The cleaner stand of claim 11, wherein the suction unit holder comprises a holding surface formed with a plane perpendicular to the second direction in a lower surface of the suction unit holder to restrict the movement of the suction unit.

13. The cleaner stand of claim 12, wherein the suction unit holder further comprises a mounting guide inclined in the first and second directions to guide the cleaner placed in the stand body.

14. The cleaner stand of claim 5, wherein suction unit holder is configured to be elastically movable by the movement of the suction unit, and the unlocking protrusion is positioned in an end portion of the suction unit holder to elastically press the release button.

15. A cleaning apparatus comprising:

a cleaner comprising a cleaner body and a suction unit lockable with the cleaner body; and a cleaner stand to which the cleaner is mountable, wherein while the cleaner, having the suction unit locked with the cleaner body, is mounted to the cleaner stand in a mounted state, the cleaner stand is configured to unlock a locking of the cleaner body and the suction unit so that the cleaner body is separable from the suction unit, wherein in a first operating mode, from the mounted state, when the cleaner is separated from the cleaner stand in a first direction, the cleaner stand is configured to lock the cleaner body and the suction unit together by releasing an unlocking of the cleaner body and the suction unit which have been unlocked by the cleaner stand in the mounted state so that the cleaner stand is configured to allow the cleaner, having the suction unit locked with the cleaner body, to be separated from the cleaner stand, and wherein in a second operation mode, from the mounted state, when the cleaner is separated from the cleaner stand in a second direction, the cleaner stand is configured to allow only the cleaner body of the cleaner to be separated from the cleaner stand cleaner while holding the suction unit to remain mounted to the cleaner stand.

16. The cleaning apparatus of claim 15, wherein the cleaner comprises a release button provided in the suction unit and configured to be pressed to lock or unlock the cleaner body when the cleaner is mounted to the cleaner stand, and the cleaner stand comprises:

a stand body configured to form a receiving space in which a part of the cleaner is to be received therein; and an unlocking protrusion formed in the stand body to be exposed to the receiving space and configured to press the release button to allow the cleaner body to operate in the third operating mode.

17. The cleaning apparatus of claim 16, wherein the cleaner further comprises a button groove formed in a way that the release button is pressed, and into which the unlocking protrusion is inserted, and the unlocking protrusion comprises a stopper surface formed to face a button groove forming surface forming a lower surface of the button groove, so as to restrict a movement of the suction unit in the second direction.

18. The cleaning apparatus of claim 17, wherein the cleaner further comprises an insertion groove formed in a position different from the button groove on an outer surface of the suction unit, the cleaner stand further comprises a suction unit holder disposed in the stand body to hold the suction unit, and the suction unit holder comprises a holder surface formed to face an insertion groove forming surface forming a lower surface of the insertion groove, so as to restrict the movement of the suction unit in the second direction, together with the stopper surface.

19. A cleaning apparatus comprising:

a cleaner comprising a cleaner body, a suction unit lockable with the cleaner body, and a release button configured to release a locking of the suction unit and the cleaner body; and a cleaner stand to which the cleaner is mounted, wherein the cleaner stand comprises:

a stand body to receive a part of the cleaner body of the cleaner therein;

a suction unit holder disposed in the stand body and to which the suction unit is mountable; and an unlocking protrusion configured to allow the cleaner body and the suction unit to be separable by pressing the release button to unlock a locking of the cleaner body and the suction unit when the cleaner is mounted to the cleaner stand, wherein while the cleaner, having the suction unit locked with the cleaner body, is mounted to the cleaner stand in a mounted state, the unlocking protrusion is configured to press the release button to unlock the locking of the cleaner body and the suction unit, wherein in a first operation mode, from the mounted state, when the cleaner is separated from the cleaner stand in a first direction, the unlocking protrusion releases the pressing of the release button and as the mounting of the suction unit holder is released, the suction unit is locked with the cleaner body so as to be separated together with the cleaner body from the cleaner stand, and wherein in a second operation mode, from the mounted state, when the cleaner is separated from the cleaner stand in a second direction, the unlocking protrusion maintains the pressing of the release button and as the mounting of the suction unit holder is maintained, only the cleaner body is separated from the cleaner stand while having the suction unit to remain mounted to the suction unit holder.

* * * * *